US005786842A

United States Patent [19]

Awai et al.

[11] Patent Number: 5,786,842

[45] Date of Patent: Jul. 28, 1998

[54] RECORDING APPARATUS WHICH CONTROLS INK SHEET SLACK AND METHOD FOR THE SAME

[75] Inventors: Takashi Awai; Minoru Yokoyama, both of Yokohama; Yasushi Ishida, Tokyo; Akihiro Tomoda; Masakatsu Yamada, both of Yokohama; Takehiro Yoshida, Tokyo; Makoto Kobayashi, Tama; Satoshi Wada, Kawasaki; Takeshi Ono; Tomoyuki Takeda, both of Yokohama, all of Japan

[73] Assignee: Canon Kabushiki Kaisha, Tokyo, Japan

[21] Appl. No.: 483,155

[22] Filed: Jun. 7, 1995

Related U.S. Application Data

[63] Continuation of Ser. No. 48,937, Apr. 20, 1993, which is a continuation of Ser. No. 553,697, Jul. 18, 1990.

[30] Foreign Application Priority Data

Jul. 19, 1989 [JP] Japan ..... 1-184411
Jul. 20, 1989 [JP] Japan ..... 1-186108

[51] Int. Cl.[6] ..... B41J 17/10

[52] U.S. Cl. ..... 347/217; 347/215

[58] Field of Search ..... 347/217, 215, 347/218; 400/234

[56] References Cited

U.S. PATENT DOCUMENTS

| | | | |
|---|---|---|---|
| 4,527,172 | 7/1985 | Nagashima et al. | 347/217 |
| 4,771,296 | 9/1988 | Shimada et al. | 346/76 PH |
| 4,980,717 | 12/1990 | Kiguchi et al. | 355/50 |
| 5,115,255 | 5/1992 | Kobayashi et al. | 346/76 PH |
| 5,122,882 | 6/1992 | Ishida et al. | 358/296 |
| 5,179,390 | 1/1993 | Yokoyama et al. | 346/76 PH |
| 5,193,007 | 3/1993 | Yokoyama et al. | 358/296 |
| 5,204,692 | 4/1993 | Awai et al. | 346/76 PH |
| 5,206,661 | 4/1993 | Terajima et al. | 346/76 PH |
| 5,243,360 | 9/1993 | Tomoda et al. | 346/76 PH |
| 5,248,994 | 9/1993 | Yoshida et al. | 346/76 PH |
| 5,369,422 | 11/1994 | Yoshida et al. | 346/76 PH |
| 5,371,523 | 12/1994 | Wada et al. | 346/76 PH |
| 5,384,584 | 1/1995 | Yoshida et al. | 346/76 PH |

FOREIGN PATENT DOCUMENTS

| | | | |
|---|---|---|---|
| 0027559 | 4/1981 | European Pat. Off. . | |
| 0201686 | 11/1983 | Japan . | |
| 0095177 | 6/1984 | Japan . | |
| 0150773 | 8/1984 | Japan | 400/234 |
| 01554483 | 8/1985 | Japan | 400/234 |
| 0024490 | 2/1986 | Japan | 400/234 |
| 62-181168 | 8/1987 | Japan . | |
| 63-84961 | 4/1988 | Japan . | |
| 63-128966 | 6/1988 | Japan . | |
| 63-205274 | 8/1988 | Japan . | |
| 63-267589 | 11/1988 | Japan . | |

OTHER PUBLICATIONS

Eur. Pat. Off. Search Report for Eur. Pat. App. No. 90113884.2.

*Primary Examiner*—Huan H. Tran
*Attorney, Agent, or Firm*—Fitzpatrick, Cella, Harper & Scinto

[57] ABSTRACT

In a thermal transfer recording apparatus, an image is recorded on a recording medium by transferring ink from an ink sheet. The apparatus includes a holder for the ink sheet, conveyors for the ink sheet and recording medium, and an ink sheet detector. When the detector determines that the ink sheet is loaded into the holder, the ink sheet is conveyed so as to take up the slack in the ink sheet until the ink sheet reaches a predetermined speed.

29 Claims, 19 Drawing Sheets

RECORDING APPARATUS WHICH CONTROLS INK SHEET SLACK AND METHOD FOR THE SAME

This application is a continuation of application Ser. No. 08/048,937 filed Apr. 20, 1993, which is a continuation of application Ser. No. 07/553,697 filed Jul. 18, 1990.

BACKGROUND OF THE INVENTION

1. Field of the Invention

The present invention relates to a thermal transfer recording apparatus for recording an image on a recording medium by transferring ink on an ink sheet onto the recording medium and a thermal transfer method.

The thermal transfer recording apparatus can be used as, for example, an electronic typewriter, a copying apparatus, or a printing apparatus other than a facsimile apparatus.

2. Related Background Art

A general thermal transfer printer uses an ink sheet in which heat melting (or heat sublimating) ink is applied onto a base film, selectively heats the ink sheet by energizing a thermal head in accordance with image signals, and transfers the melted (or sublimated) ink onto a recording medium so as to record an image on the recording medium. In general, the ink sheet is conveyed by winding the ink sheet taken out from a supply roll, around which the ink sheet is wound onto a take-up roll. An ink sheet cartridge contains an ink sheet supply roll and an ink sheet take-up roll package as a unit so that such an ink sheet can be easily loaded into a main body of a thermal transfer recording apparatus.

In the cartridge with such a composition, the ink sheet is sometimes slackened between the supply roll and the take-up roll due to the transport and handling of the cartridge. In the case that the cartridge in which the ink sheet is slack is loaded into the main body of the apparatus and a recording operation is performed, even if the take-up roll makes an effort to wind the ink sheet with the rotation thereof, the ink sheet is not conveyed and it is likely that the quality of the recorded image will be lowered due to a defective transfer. Therefore, conventionally, after the cartridge is loaded, an operator manually rotates the take-up roll so as to rewind the ink sheet and take up the slack of the ink sheet.

However, such operation is troublesome, and, in particular, if the cartridge is still loaded in the apparatus without taking in the slack of the ink sheet, the ink sheet may become wrinkled and folded, besides the lowering of the quality of the recorded image as described above. Furthermore, since it is necessary to mount a lever or the like in the cartridge so as to rotate such a take-up roll, the number of components of the cartridge is increased, and the cost of the cartridge is also increased.

An ink sheet with which a plurality of image recording operations are possible (what is called a multi-printing sheet) is well-known. With use of this ink sheet, when the recording length L is continuously recorded, the recording operation is possible while the transport length of the ink sheet conveyed after each image recording operation or during each image recording operation is shorter than the length L (L/n, n>1). As a result, the use efficiency of the ink sheet will be n times greater than that of the conventional ink sheet and it can be expected that the running cost of the thermal transfer printer will be lowered. Such printing method will hereinafter be called "multi-printing".

In particular, in the case of such multi-printing, if less than a predetermined tension is applied to the ink sheet at the beginning of the recording operation, it is likely that the ink sheet and a recording sheet will be stuck with each other at the beginning of the recording operation, and that the image recording operation can not be normally executed.

Furthermore, in the case of such multi-printing, since the velocity of the ink sheet is lower than that of the recording sheet in the recording process, the ink sheet is likely to be wrinkled or slackened due to the friction between the ink sheet and the recording sheet.

Still furthermore, a cutter is normally provided for cutting the recorded sheet to page length. Particularly, it is preferable to mount a cutter for cutting the recording sheet to pages in a facsimile apparatus. However, if such a cutter is provided, it is necessary to convey the recording sheet toward the cutter (what is called front feed) after one page is recorded, or to return a portion near the leading edge of the recording sheet to a position where the recording operation is performed by a thermal head (what is called back feed) after the recording sheet is cut by the cutter. During such conveying operation, wrinkles are likely to arise on the ink sheet.

SUMMARY OF THE INVENTION

An object of the present invention is to provide a thermal transfer apparatus and a thermal transfer method which can provide a clear image.

Another object of the present invention is to provide a thermal transfer apparatus and a thermal transfer method which can prevent an ink sheet from being slackened and wrinkled.

Another object of the present invention is to provide a thermal transfer apparatus and a thermal transfer method which can take up slack and wrinkles which arise on an ink sheet.

With the above conventional apparatus and method in mind, still another object of the present invention is to provide a thermal transfer apparatus and a thermal transfer method in which a predetermined length of an ink sheet is automatically wound so as to take up slack and wrinkles thereon when ink sheet cartridge is loaded.

Still another object of the present invention is to provide a thermal transfer apparatus and a thermal transfer method in which it is detected whether a cover of a recording apparatus for attaching and detaching an ink sheet therethrough is open or closed, and a predetermined length of the ink sheet is wound in accordance with the detection result so as to take up slack and wrinkles on the ink sheet.

A still further object of the present invention is to provide a thermal transfer apparatus and a thermal transfer method which can prevent slack and wrinkles from arising on a ink sheet by tensioning the ink sheet when a recording medium is conveyed backward at a time other than during the recording operation.

DETAILED DESCRIPTION OF THE PREFERRED EMBODIMENTS

The first embodiment is a thermal transfer recording apparatus and a thermal transfer recording method which records an image on a recording medium by transferring ink on an ink sheet onto the recording medium, and further automatically conveys the ink sheet by a predetermined amount so as to take up the slack in the ink sheet when it is detected that the ink sheet is loaded in the main body of the apparatus, cause a recording means to effect or act on the ink sheet, transferring the ink on the ink sheet onto the recording medium, and record an image on the recording medium.

A preferred embodiment of the present invention will now be described in detail with reference to the accompanying drawings.

[Description of Facsimile Apparatus (FIGS. 1 to 4)]

Figure 1A:
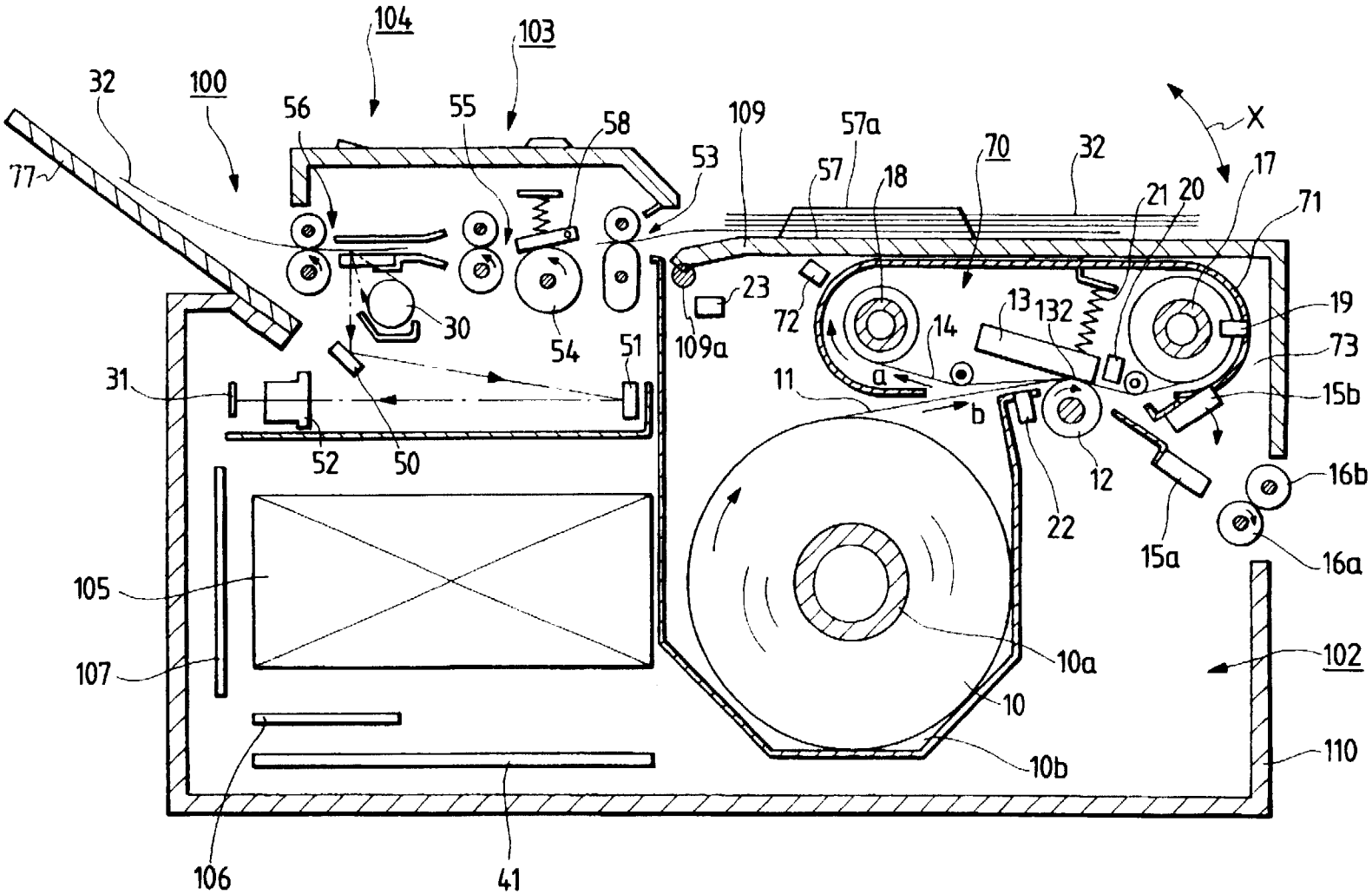
FIG. 1A is a sectional side view of a mechanism unit in a facsimile apparatus of an embodiment to which the present invention is applied.
Figure 1B:
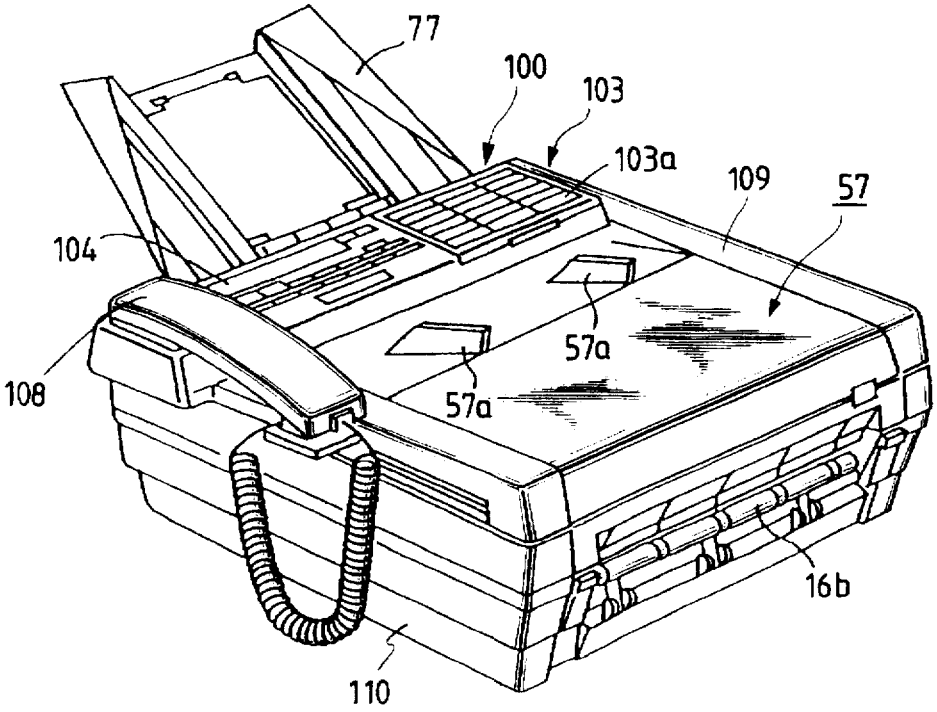
FIG. 1B is an outward perspective view of the apparatus.
Figure 2:
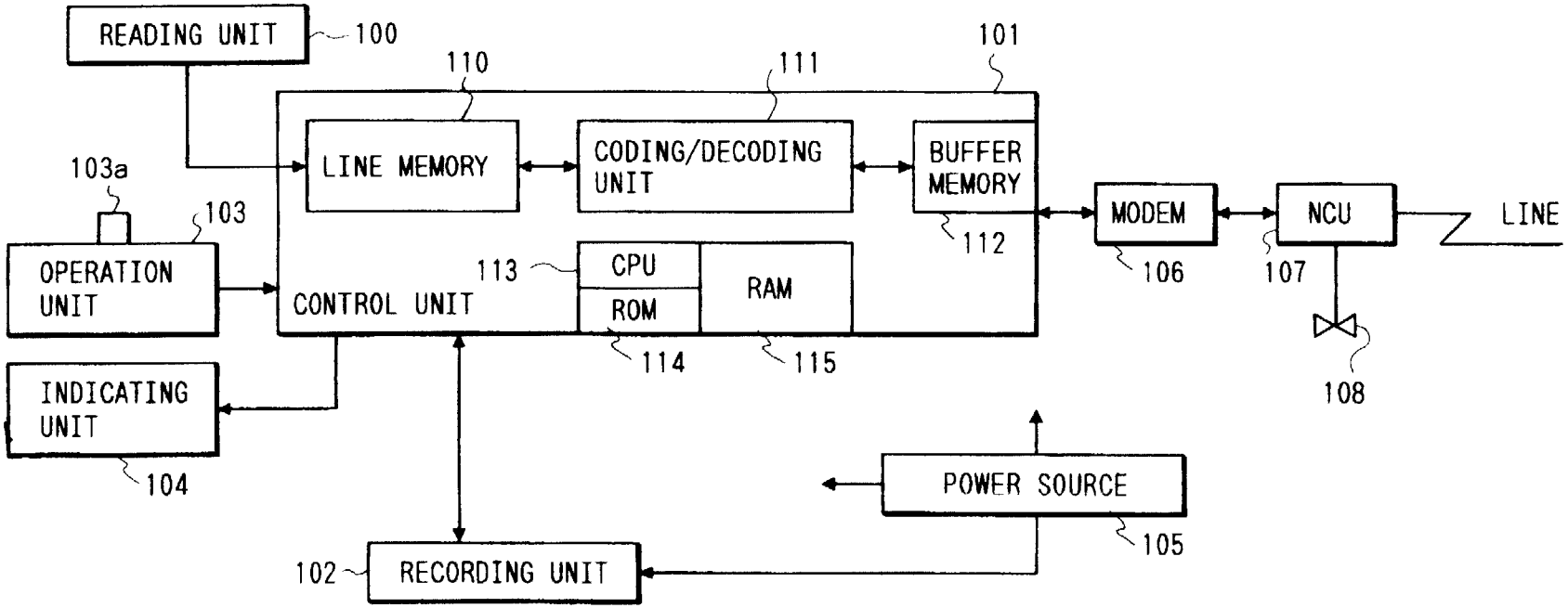
FIG. 2 is a block diagram schematically showing a composition of the facsimile of the embodiment.

FIGS. 1 to 4 show a facsimile apparatus as a thermal transfer recording apparatus which uses an embodiment of the present invention. FIG. 1A is a sectional side view of the facsimile apparatus, FIG. 1B is an outward perspective view of the facsimile apparatus, and FIG. 2 is a block diagram schematically showing a composition of the facsimile apparatus.

Referring to FIG. 2, the schematic composition will be described.

In FIG. 2, 100 is a reading unit which photo-electrically reads a document, converts the document to digital picture signals and outputs the signals to a control unit 101 in its own apparatus (in copy mode) or to another apparatus (in facsimile mode), and is provided with a motor for conveying the document, a CCD image sensor and so on. The control unit 101 controls the whole apparatus. The composition of the control unit 101 will be described. 110 is a line memory for storing image data for each line of picture data. It stores image data for a line from the recording unit 100 in transmitting or copying the document, and stores image data for a line in received decoded picture data in receiving the picture data. Then, an image is formed by outputting the stored data to a recording unit 102. 111 is a coding/decoding unit for coding picture information to be transmitted by an MH coding method or the like and for decoding and converting the received coded picture data into image data. 112 is a buffer memory for storing the coded picture data which is to be transmitted or which has been received. These components of the control unit 101 and the whole apparatus are controlled by a CPU 113, for example, a microprocessor. Besides the CPU 113, the control unit 101 comprises a ROM 114 for storing a control program and various kinds of data, a RAM 115 for temporarily holding the data as a work area of the CPU 113, and so on.

The recording unit 102 is provided with a thermal line head, which has a plurality of heating elements 132 over the same width as the recording width, and which records an image on a recording sheet by a thermal transfer recording method. The composition of the recording unit 102 will be described in detail below with reference to FIGS. 1A and 1B. 103 is an operation unit which comprises direction keys for various functions, such as the start of transmitting, input keys for telephone numbers and so on. 103*a* is a switch which is operated by an operator to direct the kind of ink sheet 14 to be used. The ON state of the switch 103*a* shows that an ink sheet for multi-printing is loaded and the OFF state of the switch 103*a* shows that a normal ink sheet (one-time ink sheet) is loaded. 104 is an indicating unit for normally indicating the functions mounted in the control unit 103 and the state of the apparatus. 105 is a power source unit for supplying electric power to the whole apparatus. 106 is a modem (modulator/demodulator device) for modulating and demodulating transmitted and received signals. 107 is a network control unit (NCU) for controlling communication over a line, and 108 is a telephone provided with dial keys for a phone call.

Next, the structure of the whole apparatus will be described in detail with reference to FIGS. 1A and 1B. The components common to those shown in FIG. 2 are denoted by the same numerals.

Figure 10:
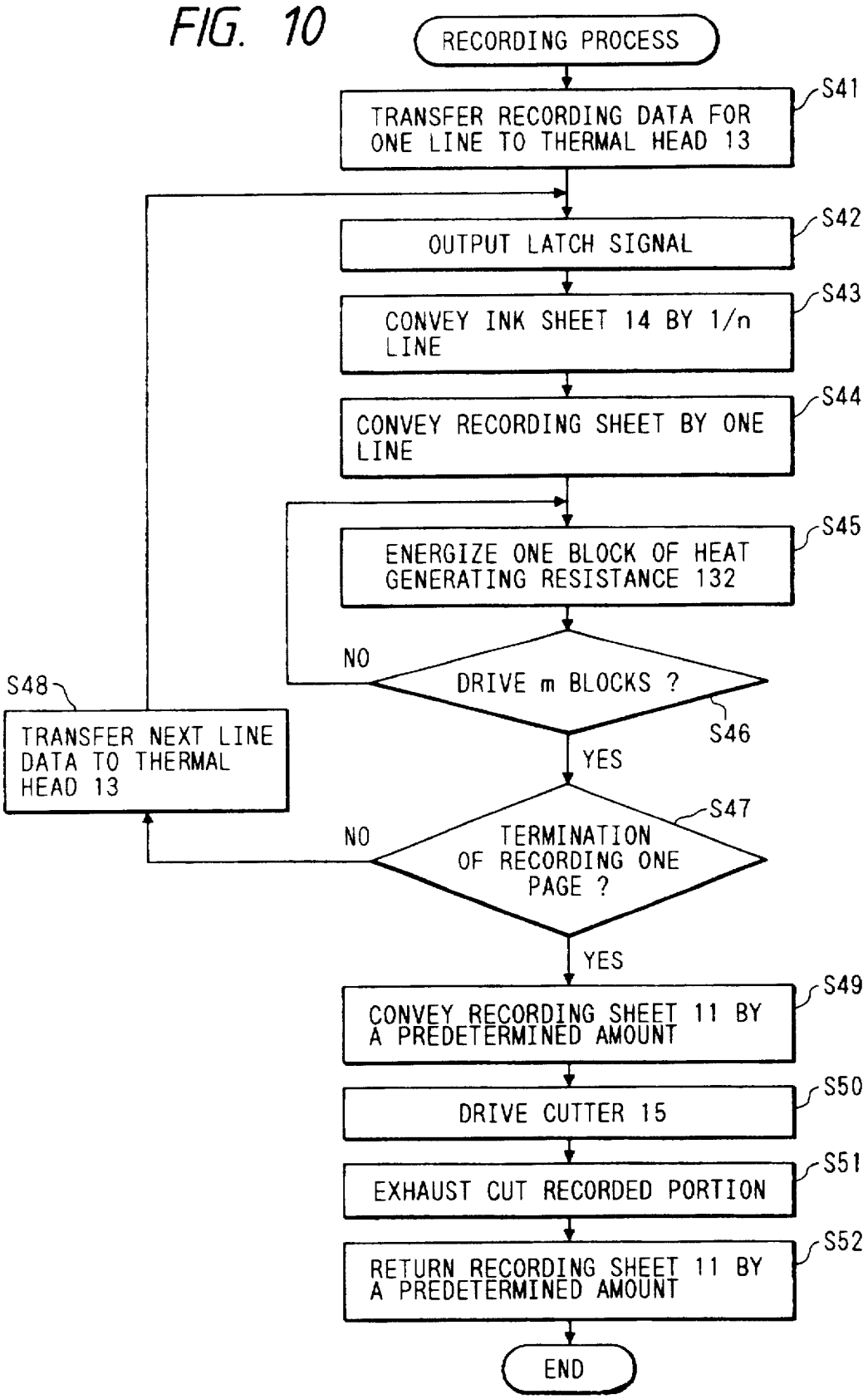
FIG. 10 is a flowchart showing a recording process in the facsimile apparatus of the embodiment.

In FIGS. 1A and 1B, 10 is a roll sheet in which a recording sheet 11 made of plain paper is rolled around a core 10*a*. The roll sheet 10 is rotatably contained in the apparatus so that the recording sheet 11 can be supplied to a thermal head 13 by rotation in the direction of the arrow of a platen roller 12 which is rotatably driven by a motor 24, described below, for conveying the recording sheet. 10*b* is a loading unit for the roll sheet 10 and the roll sheet 10 is detachably loaded therein. Furthermore, the platen roller 12 conveys the recording sheet 11 in the direction of the arrow b and presses an ink sheet 14 and the recording sheet 11 between the heating elements 132 of the thermal head 13 and the platen roller 12. The recording sheet 11 on which an image has been recorded by heating the thermal head 13 is conveyed toward discharge rollers 16*a* and 16*b* by the further rotation of the platen roller 12, cut into page lengths by the engagement of cutters 15*a* and 15*b* when the image recording operation for a page is completed, and is discharged.

17 is an ink sheet supply roll for winding the ink sheet 14 therearound, and 18 is an ink sheet take-up roll which is driven by an ink sheet conveying motor, described below, so as to take up the ink sheet 14 in the direction of the arrow a. The ink sheet supply roll 17 and the ink sheet take-up roll 18 are contained in an ink sheet cartridge 71. The ink sheet cartridge 71 is detachably loaded in an ink sheet loading unit 70 in the main body of the apparatus, and can be loaded into and detached from the loading unit 70 by lifting and opening a cover 109. The cover 109 can swing in the direction of the arrow x from the main body 110 of the apparatus around a shaft 109*a*. The top plane of the cover 109 functions as a document tray 57, described below, on which a plurality of documents can be piled. 72 is a cartridge sensor which is disposed opposite to the loading unit 70 and which can detect whether or not the cartridge 71 is detachably loaded in a loading unit 73 of the main body. Furthermore, 23 is an open/closed sensor for the cover 109 which is disposed on the side of the main body of the apparatus which can detect that the cover 109 is opened or closed. When the sensor 23 is obstructed by a side plate 109*b* of the cover 109, it detects that the cover 109 is closed, and when it is not obstructed, it detects that the cover 109 is open.

19 is a sensor for detecting the remaining amount of the ink sheet 14 wound around the ink sheet supply roll 17 and the conveyance velocity of the ink sheet 14. 20 is an ink sheet sensor for detecting the presence of the ink sheet 14 and the remaining amount of the ink sheet 14 based on a mark attached to the ink sheet 14, and 21 is a spring for pressing the thermal head 13 against the platen roller 12 through the recording sheet 11 and the ink sheet 14. 22 is a recording sheet sensor for detecting the presence of the recording sheet 11.

Next, the structure of the reading unit 100 will be described.

In FIG. 1A, 30 is a light source for irradiating a document 32. The light which is radiated from the light source 30 and reflected by the document 32 is input to a CCD sensor 31 through an optical system (mirrors 50 and 51 and a lens 52) and converted into electric signals. The document 32 is conveyed by conveying rollers 53, 54, 55 and 56, which are driven by a document conveying motor (not shown), in accordance with the reading velocity of the document 32. A plurality of documents 32 piled on the document tray 57 are guided by a slider 57*a*, separated one by one by the correlative movement of the conveying roller 54 and a press separation strip 58, conveyed to the reading unit 100, and discharge onto a tray 77.

41 is a control substrate constituting a main portion of the control unit 101 and outputting various control signals to each component. 106 is a modem substrate unit for performing communication processes, and 107 is a NCU substrate unit for functioning as a relay device between a telephone line and the apparatus.

Figure 3:
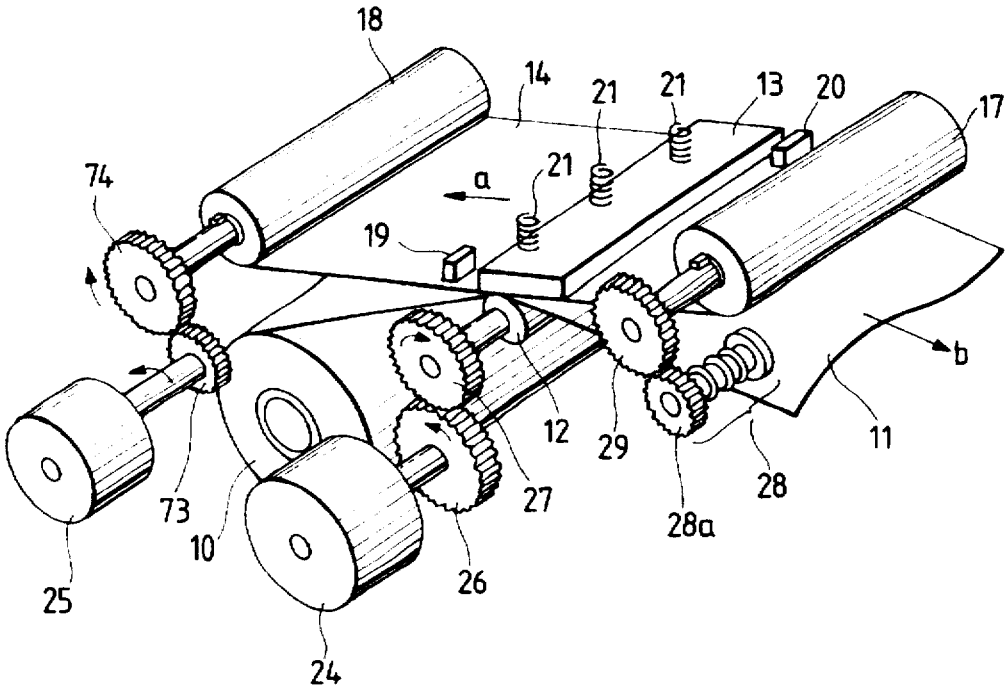
FIG. 3 is a view showing a structure of a system for conveying an ink sheet and a recording sheet.

Furthermore, FIG. 3 is a detailed view showing a conveying mechanism for the ink sheet 14 and the recording sheet 11.

In FIG. 3, 24 is a recording sheet conveying motor for rotatably driving the platen roller 12 so as to convey the recording sheet 11 in the direction of the arrow b reverse of the direction of the arrow a. 25 is an ink sheet conveying motor for conveying the ink sheet 14 in the direction of the arrow a. 26 and 27 are transmission gears for transmitting the rotation of the recording sheet conveying motor 24 to the platen roller 12, and 73 and 74 are transmission gears for transmitting the rotation of the ink sheet conveying motor 25 to the take-up roll 18. 28 is a slip clutch which engages a gear 29 mounted on a rotation shaft of the ink sheet supply roll 17 so as to become a load on the ink sheet supply roll 17 and applies tension to the ink sheet 14.

Thus, by conveying the recording sheet 11 and the ink sheet 14 in different directions, the direction in which an image is successively recorded in the longitudinal direction of the recording sheet 11 (the direction of the arrow a, the direction reverse of the conveyance direction of the recording sheet 11) corresponds to the conveyance direction of the ink sheet 14. If it is assumed that the conveyance velocity of the recording sheet 11 is $V_P$ and $V_P=-n.V_I$ ($V_I$ is the conveyance velocity of the ink sheet 14 and the sign "–" indicates that the conveyance direction of the recording sheet 11 and the conveyance direction of the ink sheet 14 are different opposite), the relative velocity $V_{PI}$ of the recording sheet 11 and the ink sheet 14 against the thermal head 13 is represented as follow:

$$V_{PI}=V_P-V_I=(1+1/n)V_P$$

The relative velocity $V_{PI}$ is higher than $V_P$ and the multi-printing operation is performed at this velocity.

Figure 4:
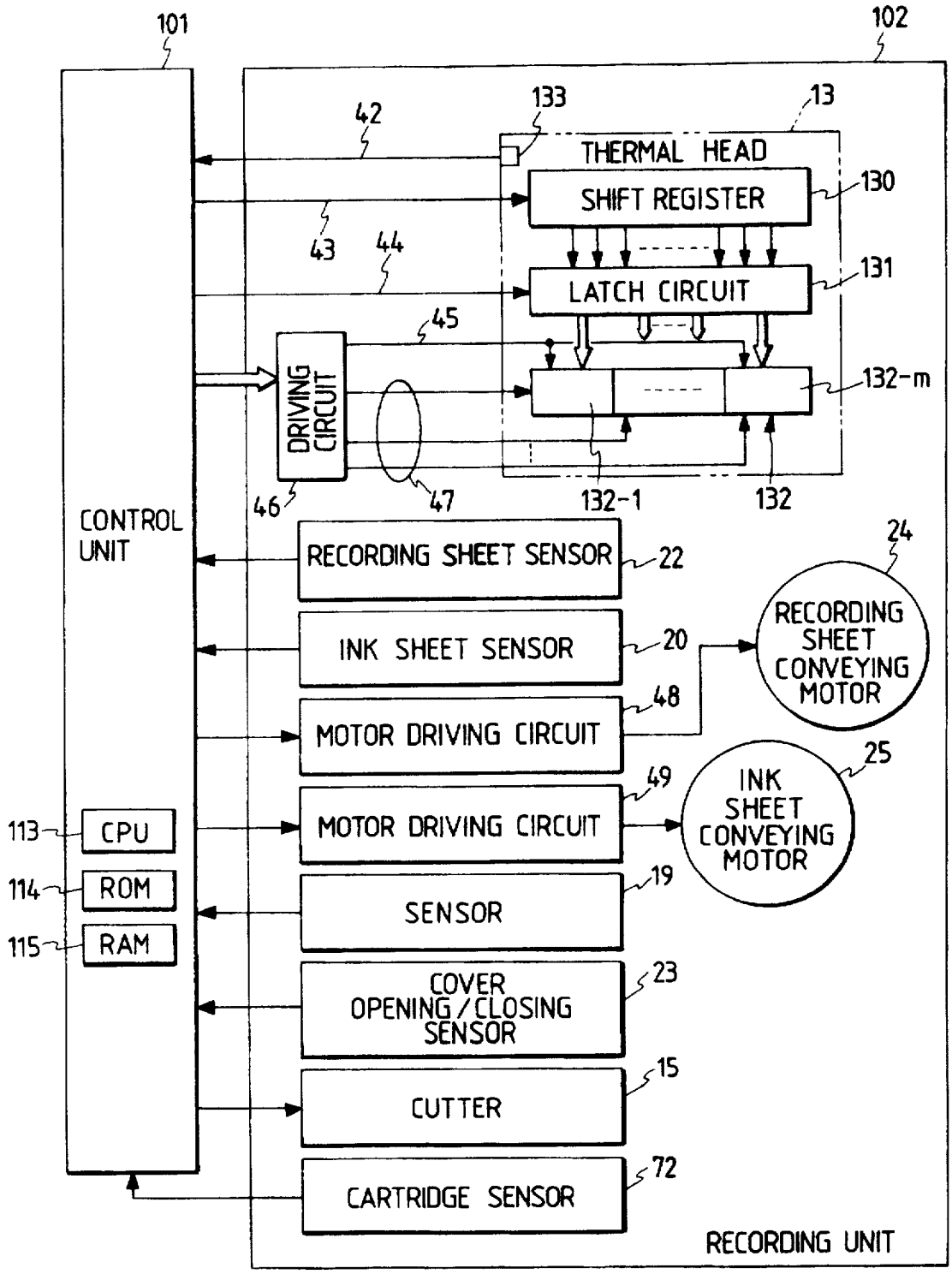
FIG. 4 is a view showing electrical connections between a control unit and a recording unit of the embodiment.

FIG. 4 is a view showing electrical connections between the control unit 101 and the recording unit 102 in the facsimile apparatus of the present embodiment. The components common to other drawings are denoted by the same numerals.

The thermal head 13 is a line head and extends over the recording area. The thermal head 13 is provided with a shift register 130 for inputting serial recording data 43 for one line from the control unit 101, a latch circuit for latching the data in the shift register 130 in response to a latch signal and a heating element 132 composed of a plurality of heat generating resistances for one line. The heating element 132 is divided into "m" number of blocks represented by 132-l to 132-m and driven. 133 is a temperature sensor, mounted to the thermal head 13, for detecting the temperature of the thermal head 13. An output signal 42 of the temperature sensor 133 is A/D-converted in the control unit 101 and input to the CPU 113. Then, the CPU 113 detects the temperature of the thermal head 13 and changes the energy applied to the thermal head 13 in accordance with the characteristic (type) of the ink sheet 14 by changing the pulse width of a strobe signal 47 or the driving voltage of the thermal head 13 in accordance with the detected temperature. The type (characteristic) of the ink sheet 14 is designated by the position of the above switch 103*a* chosen by an operator, or may be distinguished by automatically detecting a mark or the like printed on the ink sheet 14 or a mark, a notch or the like attached to the cartridge of the ink sheet 14.

46 is a driving circuit for inputting a driving signal for the thermal head 13 from the control unit 101 and outputting the strobe signal 47 to drive each block of the thermal head 13. Furthermore, the driving circuit 46 is capable of changing the energy applied to the thermal head 13 by changing the voltage output to a power source line 45, which supplies electric current to the heating element 132 of the thermal head 13, in accordance with the direction from the control unit 101. 48 and 49 are motor driving circuits for rotatably driving the recording sheet conveying motor 24 and the ink sheet conveying motor 25 respectively corresponding to the motor driving circuits 48 and 49 by changing the driving current of the corresponding motors in accordance with the direction from the control unit 101. Though the recording sheet conveying motor 24 and the ink sheet conveying motor 25 are stepping motors in this embodiment, they are not required to the stepping motors and may be, for example, DC motors.

Operations executed by the above composition will be described. First, the control unit 101 inputs picture signals from the modem 106, decodes and stores the picture signals in the line memory 110 and directs the recording unit 102 to start an image recording operation. The recording data is serially transferred from the control unit 101 to the shift register 130 in the thermal head 13 and stored in the latch circuit 131 in response to the latch signal 44. Next, the control unit 101 outputs an exciting signal to the ink sheet conveying motor 25 through the motor driving circuit 25 and outputs an exciting signal to the recording sheet conveying motor 24 through the motor driving circuit 48. Then, the ink sheet 14 is conveyed in the direction of the arrow a and the recording sheet 11 is conveyed in the direction of the arrow b. After that, the driving circuit 46 is driven so as to output the strobe signal 47 and the recording operation is performed for one line by energizing and driving each block of the heating element 132 of the thermal head 13 so as to generate heat.

The reduction gear ratio $i_P$ of the recording sheet conveying motor 24 with the transmission gears 26 and 27 and the reduction gear ratio $i_I$ of the ink sheet conveying motor 25 with the gears 73 and 74 are appropriately set, so that the relationship between the conveyance velocity $V_P$ of the recording sheet 11 and the conveyance velocity $V_I$ of the ink sheet 14 against the thermal head 13 can be expressed as follows:

$$V_P = nV_I (n>1) \quad (1)$$

In this case, when the recording length L is recorded, the recording sheet 11 is conveyed by the length L in the direction of the arrow b, while the ink sheet 14 is conveyed by only 1/n in the direction of the arrow a.

[Description of Ink Sheet Cartridge]

Figure 5:
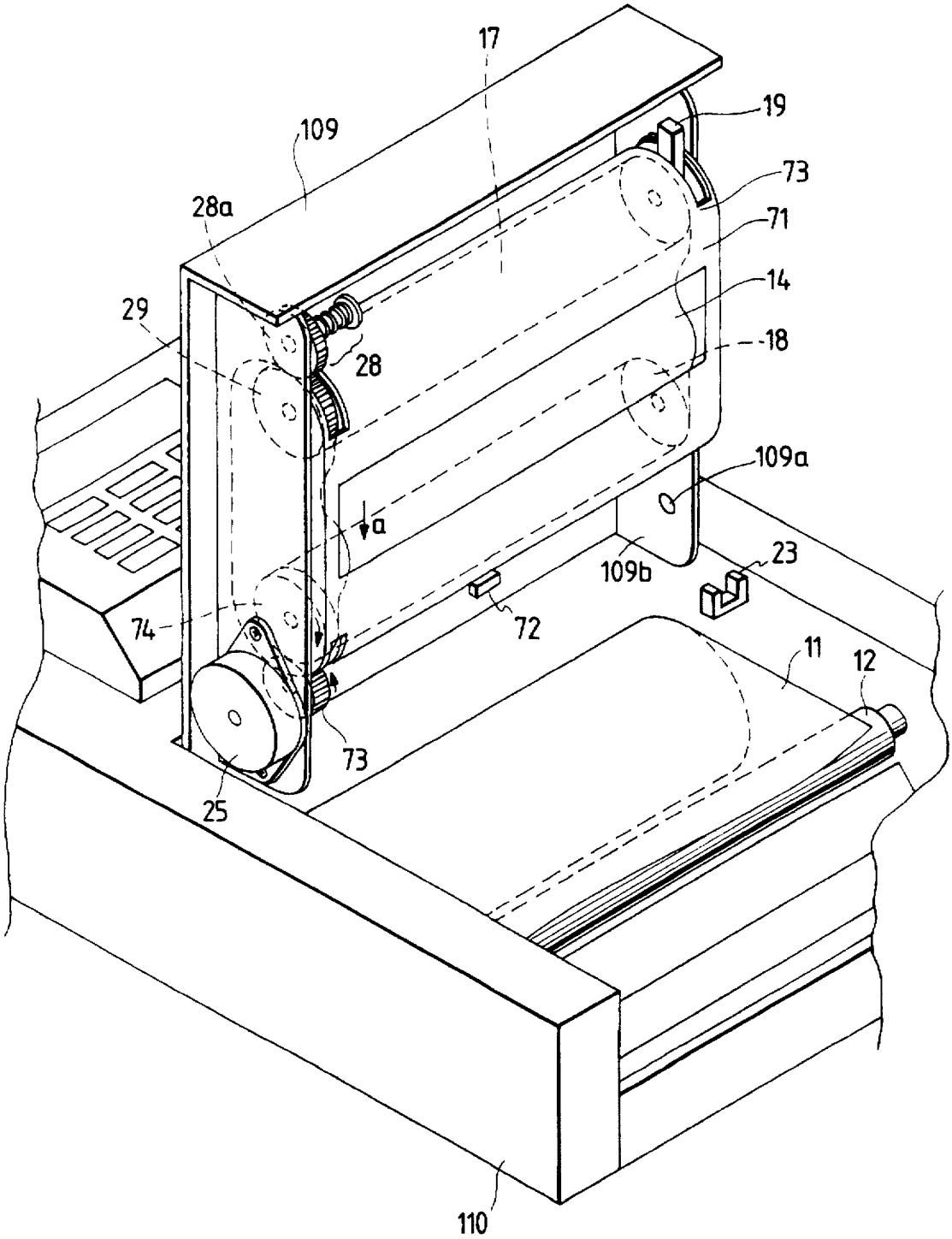
FIG. 5 is a view showing an attachment state of an ink sheet cartridge while a cover is open.

FIG. 5 shows the state in which the cover 109 of the facsimile apparatus of the present embodiment is open. The components common to the above-mentioned drawings are denoted by the same numerals and the description thereof is omitted.

As shown in the figure, the cover 109 is released from the main body 110 of the apparatus in the following cases:

(1) exchanging the ink cartridge 71

(2) loading the recording sheet roll 10

(3) correcting jamming of the recording sheet 11

In the cases (2) and (3), when it is detected by a cover open detection sensor 23 that the cover 109 is opened and it is detected by the cartridge sensor 72 that the cartridge 71 is loaded, the ink sheet conveying motor 25 is rotatably driven by a predetermined amount so as to wind the ink sheet 14 around the take-up roll 18. By rotatably driving the take-up roll 18 until the ink sheet sensor 19 detects the normal conveyance velocity of the ink sheet 14, it is possible to completely take up the slack on the ink sheet 14.

In the case (1), since it is detected by the cover open detection sensor 23 that the cover 109 is opened and it is detected by the cartridge sensor 72 that the cartridge 71 is loaded as described above, the ink sheet 14 is conveyed. After the conveyance is stopped, the ink sheet cartridge 71 is exchanged and the ink sheet 14 is conveyed again, so that the slack can be removed.

Next, referring to the flowcharts shown in FIGS. 6 to 9, the method of taking up the slack on the ink sheet 14 when the cover 109 of the recording unit 102, which contains the cartridge 71 therein, is open will be described. The control program for executing the processes in the method is stored in the ROM 114 of the control unit 101.

Figure 6:
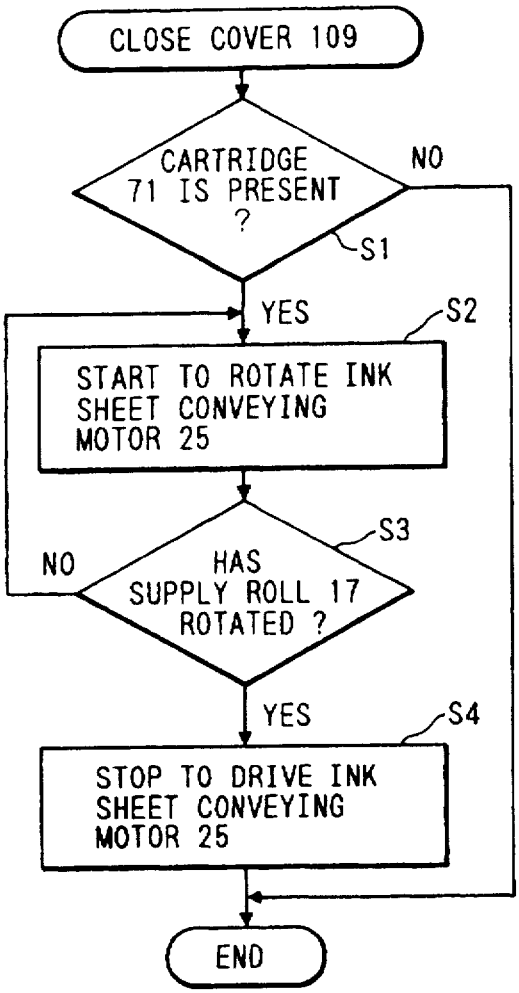
FIGS. 6 to 9 are flowcharts showing processes for removing slack of the ink sheet from the embodiment.

In the multi-printing recording method, the process shown in FIG. 6 is started when the cover 109 is closed after the cartridge 71 or the recording sheet 11 is exchanged or the like. First, in Step S1, it is detected by the cartridge sensor 72 whether or not the cartridge 71 is present. If the cartridge 71 is present, the rotation of the ink sheet conveying motor 25 is started so as to rotatably drive the ink sheet take-up roll 18 in Step S2. Then, in Step S3, it is detected based on signals from the ink sheet sensor 19 whether or not the ink sheet supply roll 17 has been rotated. If the supply roll 17 has not been rotated, Step S2 is repeated and the ink sheet conveying motor 25 is rotatably driven as described above. If it is detected that the ink sheet supply roll 17 has been rotated, the rotatable drive of the ink sheet conveying motor 25 is stopped in Step S4.

As a result, it is possible to completely take up the slack on the ink sheet 14 in the cartridge 71 and apply the necessary tension to the ink sheet 14 only by rotatably driving the ink sheet take-up roll 18 by the minimum amount (conveying the ink sheet by the minimum amount).

Figure 7:
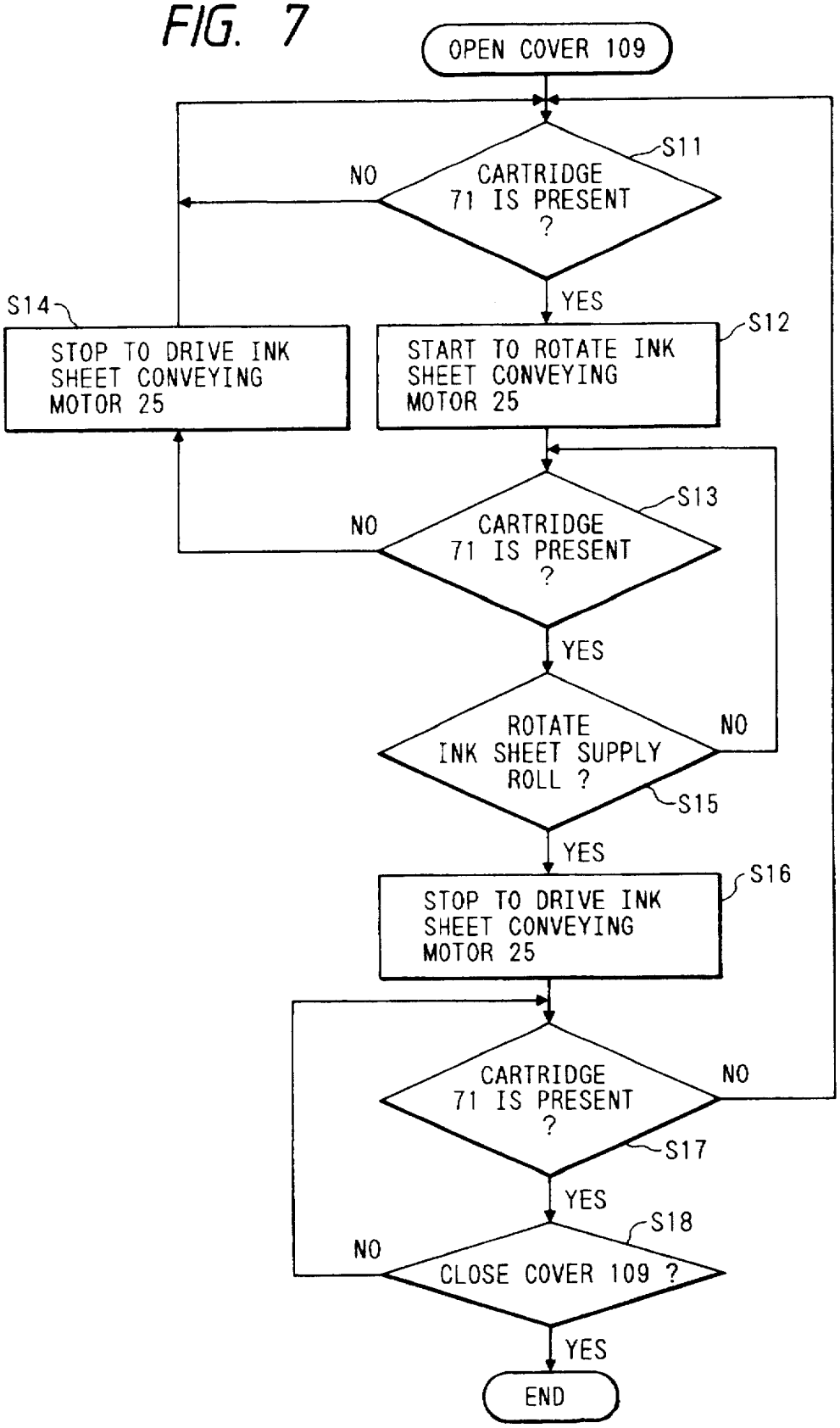

Next, FIG. 7 shows the case in which the cover 109 is opened for exchanging the recording sheet 11, the cartridge 71 or the like. First, in Step S11, it is detected, based on signals from the sensor 72, whether or not the cartridge 71 is present. If the cartridge 71 is present, the rotation of the ink sheet conveying motor 25 is started in Step S12. In Step S13, it is detected whether or not the cartridge 71 is present. If the cartridge is not present, the rotation of the ink sheet conveying motor 25 is stopped in Step S14.

If it is detected that the cartridge 71 is present in Step S13, it is detected whether or not the ink sheet 14 is pulled by the rotation of the ink sheet take-up roll 18 and the ink sheet supply roll 17 is rotated in Step S15. If the supply roll 17 is not rotated, the above operation is repeated returning to Step S13. If the ink sheet supply roll 17 is rotated, the rotation of the ink sheet conveying motor 25 is stopped in Step S16. In Step S17, it is detected whether or not the cartridge 71 is present. If the cartridge 71 is present, the cover 109 is closed in Step S18 and the process is completed.

Therefore, since when the cover 109 is opened and the cartridge 71 is exchanged, the ink sheet take-up roll 18 is rotatably driven and the ink sheet supply roll 17 rotates to wind the ink sheet 14 until it is recognized the ink sheet 14 is not slackened, the slack on the ink sheet 14 can be completely removed.

Figure 8:
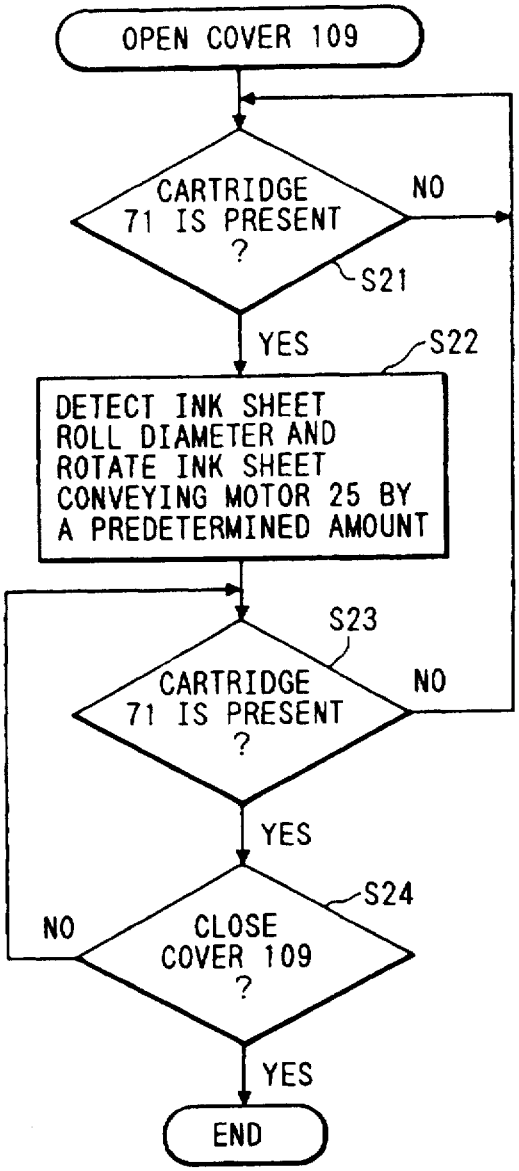

The flowchart shown in FIG. 8 is a variation of the flowchart shown in FIG. 7. In the flowchart shown in FIG. 7, after starting the rotation, the ink sheet take-up roll 18 is rotatably driven until the ink sheet supply roll 17 has started to rotate. However, in the flowchart shown in FIG. 8, in step S22 the diameter of the ink sheet roll on the ink sheet supply roll 17 is detected by the ink sheet sensor 19 and the ink sheet take-up roll 18 is rotatably driven by a predetermined amount in accordance with the detected diameter, so that the slack on the ink sheet 14 are effectively removed.

Figure 9:
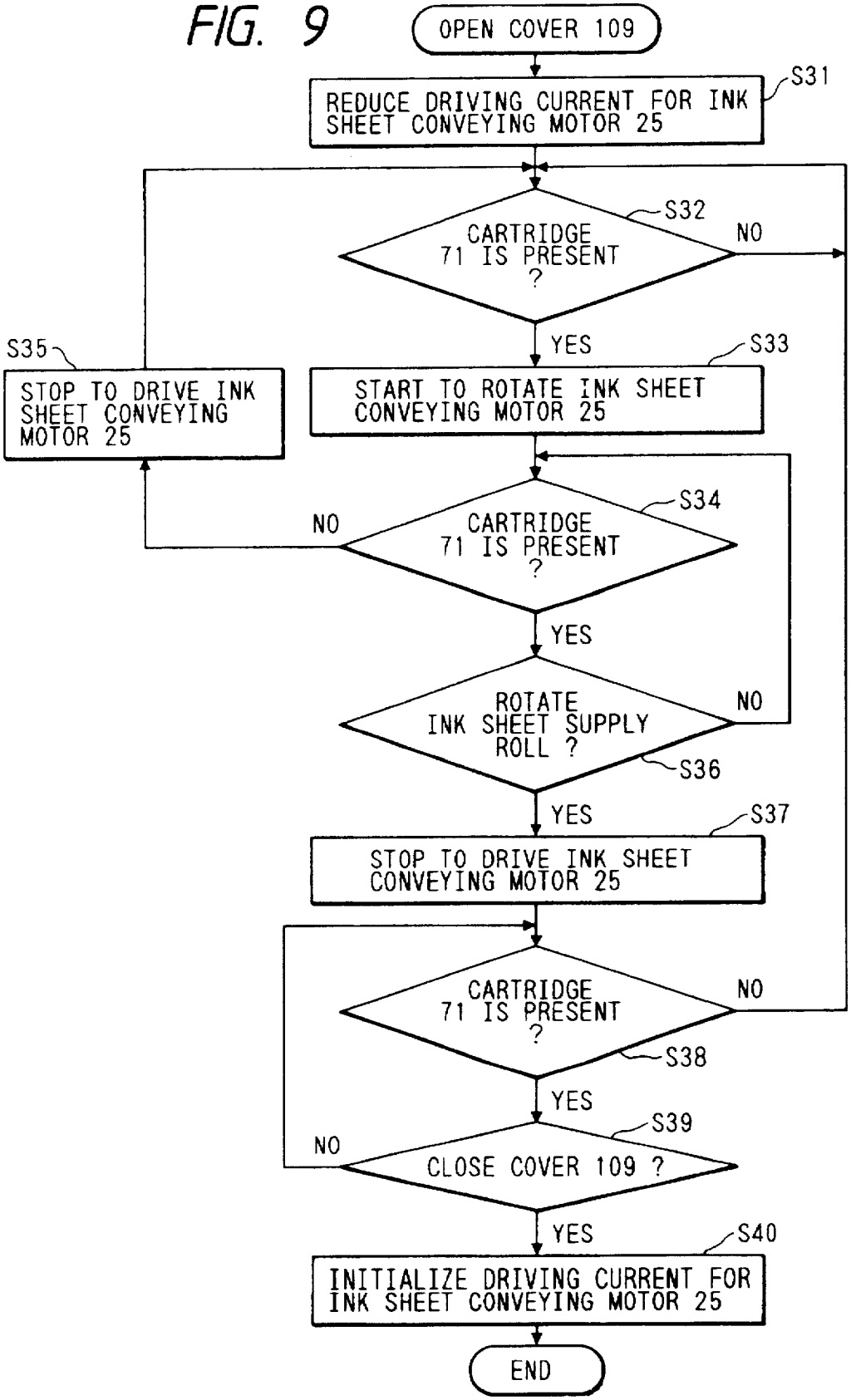

In the above embodiment, in the case the ink sheet 14 is conveyed while the cover 109 of the recording unit 102 in the facsimile apparatus is open, the frictional force between the ink sheet 14 and the recording sheet 11, and the shearing force in the ink layer, do not exist. Therefore, the load on the ink sheet conveying motor 25 is light, noises and vibrations arise due to the excess driving force, and the noises come out of the apparatus, so that the apparatus is sometimes noisy. As the flowchart in FIG. 9 shows, it can be thought that when the cover 109 is opened, the driving current for the ink sheet conveying motor 25 is reduced so that the ink sheet 14 is conveyed to take up the slack in Step S31. Then, when the cover 109 is closed in Step S39, the driving current for the ink sheet conveying motor 25 is increased and the process is completed.

Since the steps S32 to S39 are the same as the steps S11 to S18 in the flowchart shown in FIG. 7, they are not specifically described. The reduction of the driving current for the ink sheet conveying motor 25 can be easily realized by reducing the driving voltage to be output to the motor driving circuit 49.

If Step S31 shown in FIG. 9 is inserted before Step S2 in the flowchart shown in FIG. 8 and Step S40 shown in FIG. 9 is added after Step S24 shown in FIG. 8, it is similarly possible to take up the slack of the ink sheet 14 in the cartridge 71 while reducing the noise from the ink sheet conveying motor 25. Furthermore, though in the flowcharts shown in FIGS. 7 to 9 it is described that the process is started in response to the opening of the cover 109, the start of the process is not limited to this, and the process may be started when it is detected by the cartridge sensor 72 that the ink sheet cartridge 71 is exchanged (that the cartridge 71 is detached and then, loaded again).

[Description of Recording Operation (FIG. 10)]

FIG. 10 is a flowchart showing the recording process for one page in the facsimile apparatus of the present embodiment. The control program for executing this process is stored in the ROM 114 in the control unit 101.

This process is started when the image data for one line to be recorded is stored in the line memory 110 and the recording operation is ready. First, in Step S41, the recording data for one line is serially output to the shift register 130. Then, when the transfer of the recording data for one line is completed, the latch signal 44 is output in Step S42 and the recording data for one line is stored in the latch circuit 131. Next, the ink sheet conveying motor 25 is driven so as to convey the ink sheet 14 by 1/n line in the direction of the arrow a shown in FIG. 1 in Step S43.

Then, the recording sheet conveying motor 24 is driven and the recording sheet 11 is conveyed by one line in the direction of the arrow b in Step S44. The length of the one line corresponds to the length of one dot to be recorded by the thermal head 13, and, for example, is 1/15.4 mm in the case of the facsimile apparatus and the minimum image recording time is 2.5 ms.

One block of the heating element 132 of the thermal head 13 is energized in Step S45. In Step S46, it is detected whether or not all of the "m" number (=4) of blocks are energized. If all blocks of the heating element 132 are not energized, Step S45 is repeated, and the next block is energized. When the image recording operation for one line is completed in Step S46, the next Step S47 is executed, and it is detected whether or not the image recording operation for one page has been completed. If the image recording operation for one page has not been completed, the recording data for the next line is transferred to the shift register 130 in the thermal head 13 in Step S48, and Step S42 is repeated.

If the image recording operation for one page is completed in Step S47, the recording sheet 11 is conveyed by a predetermined amount toward the discharge rollers **16*a* and 16*b* until the end edge of the recorded recording sheet 11 reaches the cutting position of the cutter 15 in Step S49. Then, the cutters 15*a* and 15*b* are driven to engage to each other and cut the recording sheet 11 to pages. Next, in Step S51, the cut recording sheet is discharged by the eject roller 16 outside of the apparatus. In Step S52, the platen roller 12 is reversely rotated so as to return the recording sheet 11 by a distance corresponding to the distance between the thermal head 13 and the cutter 15 so that the leading end of the recording sheet 11** reaches the next image recording position, and then, the image recording process for one page is completed.

The value of the above "n" for determining the amount of conveying the ink sheet 14 can be, as described above, changed by changing not only the rotational amount of the recording sheet conveying motor 24 and the ink sheet conveying motor 25, but also, for example, the reduction gear ratio of the transmission gears 26 and 27 in the driving system for the platen roller 12 and the transmission gears 73 and 74 in the driving system for the take-up roller 18.

In the second embodiment, after conveying the recording medium at a time other than the image recording operation, the ink sheet is tensioned until the next recording operation is started.

Figure 11:
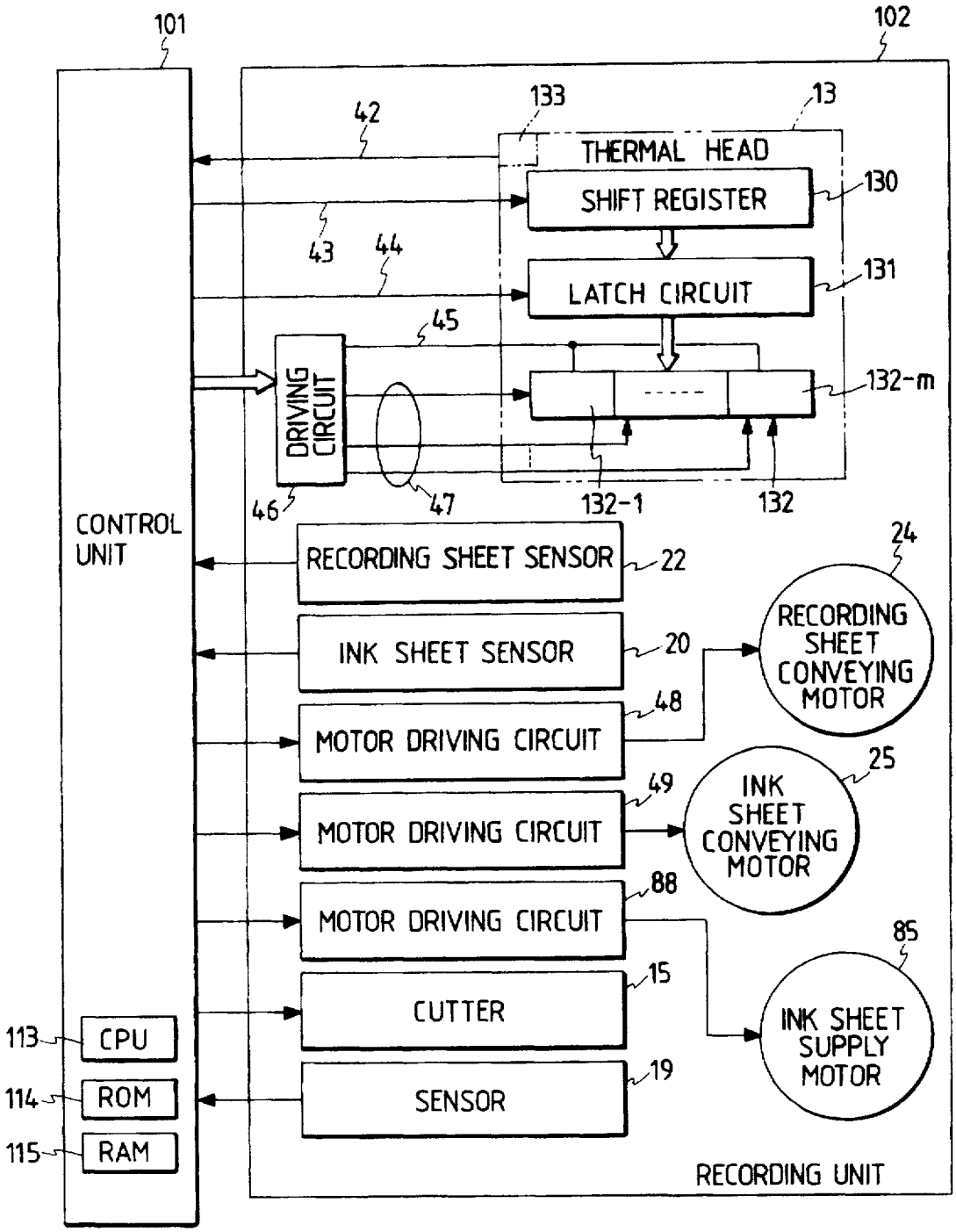
FIG. 11 is a view showing electrical connections between a control unit and a recording unit in a facsimile apparatus of another embodiment to which the invention is applied.
Figure 12:
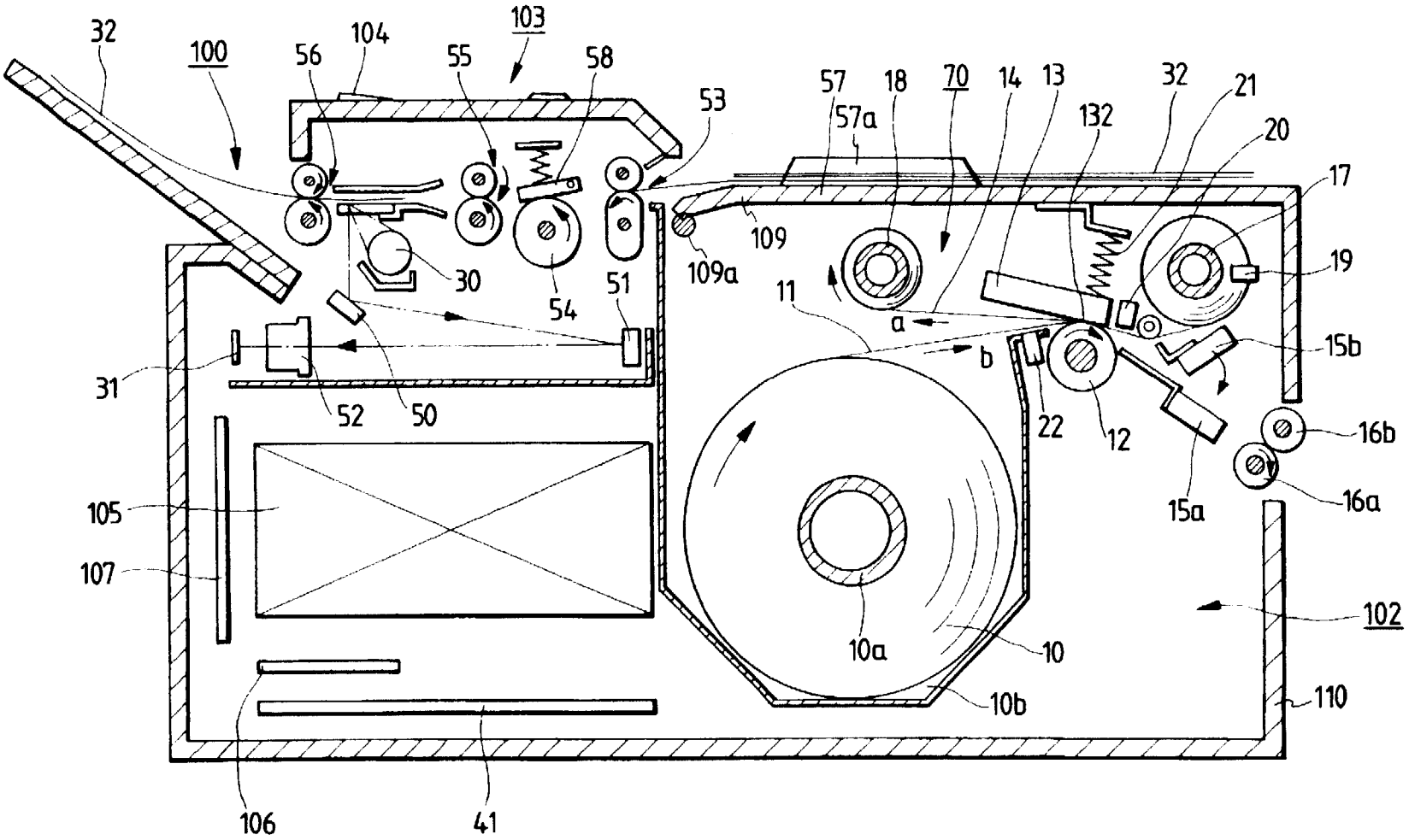
FIG. 12 is a sectional side view showing a mechanism unit of the embodiment.

FIGS. 11 and 12 show the facsimile apparatus of the second embodiment, FIG. 11 is a view showing electric connections between the control unit 101 and the recording unit 102, and FIG. 12 is a sectional side view of the facsimile apparatus. The above FIG. 2 is referred to as a block diagram schematically showing the structure of the facsimile apparatus. The components common to other drawings are denoted by the same numerals and the description thereof is referred to.

As shown in FIG. 11, a motor driving circuit 88 for rotatably driving an ink sheet supply motor 85 is mounted in the present embodiment. Furthermore, as shown in FIG. 12, the ink sheet supply roll 17 and the ink sheet take-up roll 18 are detachable and directly loaded in the ink sheet loading unit 70 in the main body of the apparatus without using an ink cartridge in the present embodiment.

Figure 13A:
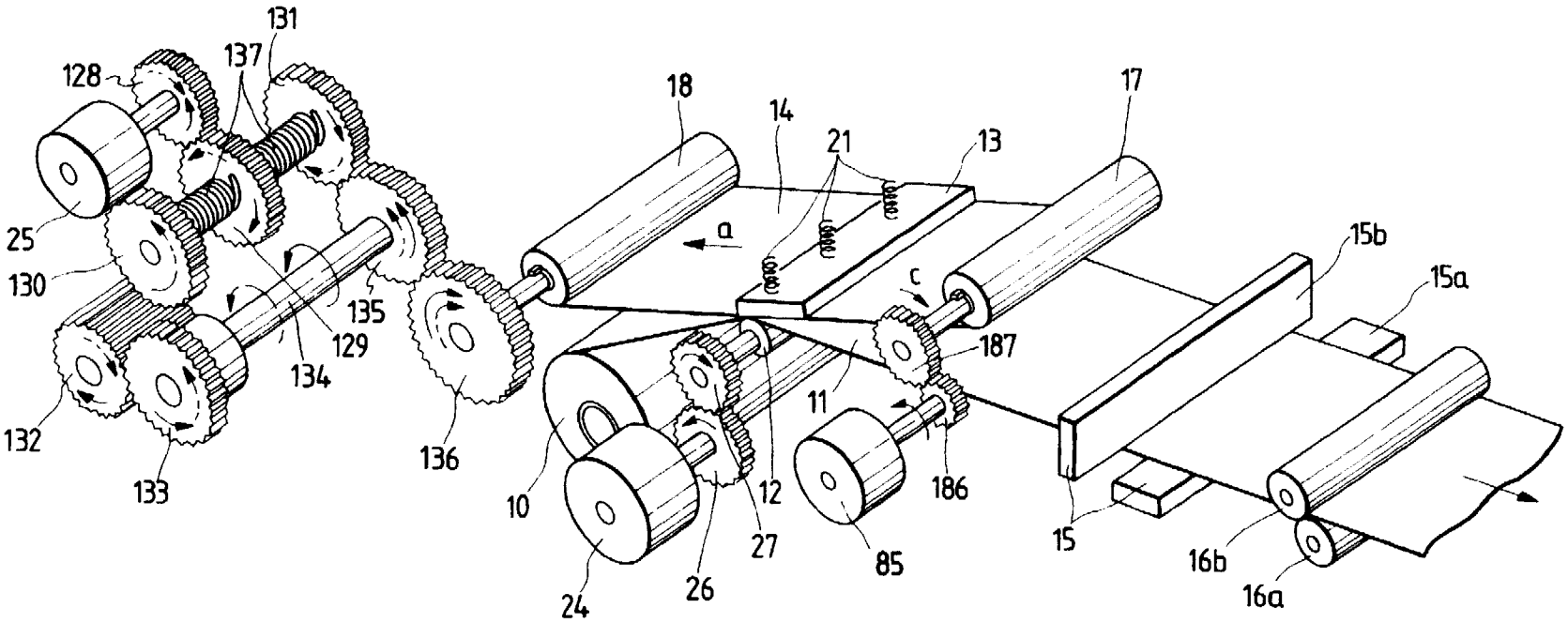
FIGS. 13A and 13B are views showing a structure of a system for conveying an ink sheet and a recording sheet.
Figure 13B:
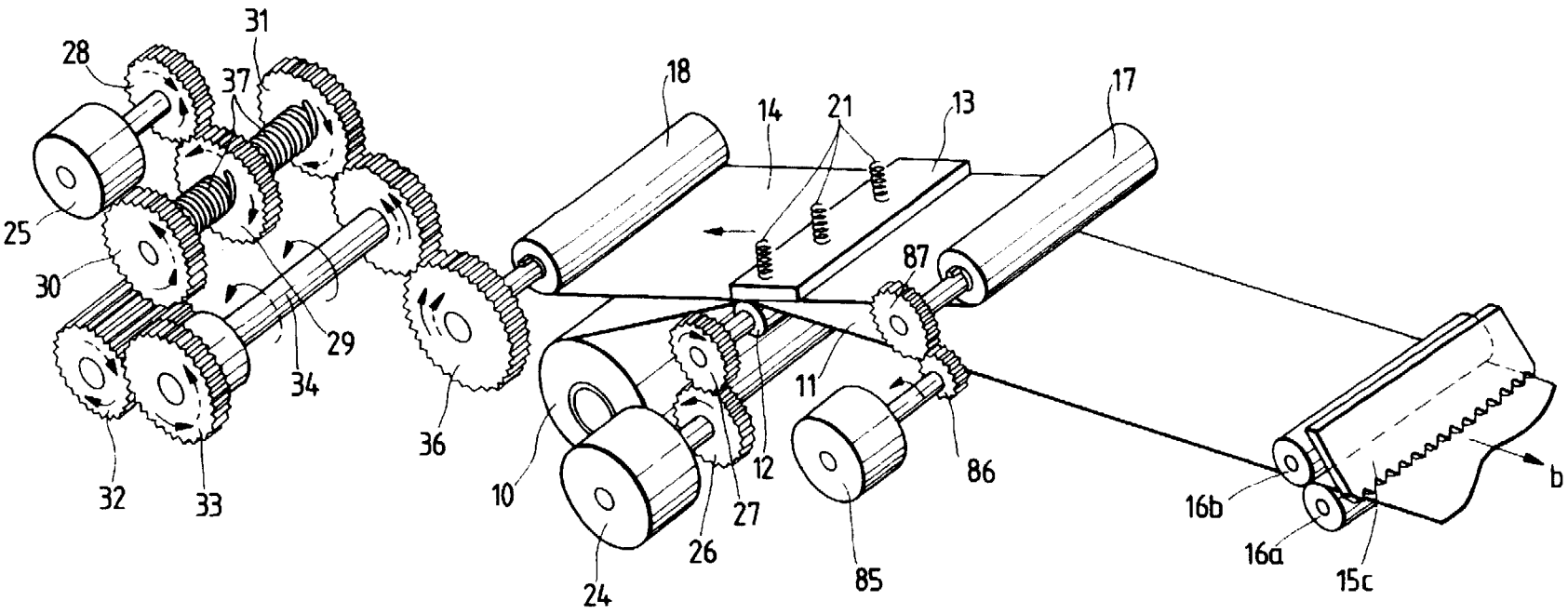

FIGS. 13A and 13B are detailed views of the mechanism for conveying the ink sheet 14 and the recording sheet 11. The same components as those shown in the above drawings are denoted by the same numerals and the description thereof is omitted.

As shown in FIG. 13A, 25 is an ink sheet conveying motor for conveying the ink sheet 14 in the direction of the arrow a by rotating in the direction indicated by the solid line, and 24 is a recording sheet conveying motor for rotatably driving the platen roller 12 and conveying the recording sheet 11 in the direction of the arrow b which is reverse of the direction of the arrow a. 26 and 27 are transmission gears for transmitting the rotation of the recording sheet conveying motor 24 to the platen roller 12, and 128, 129, 131, 135 and 136 are transmission gears for transmitting the rotation of the ink sheet conveying motor 25 to the take-up roller 18.

137 is a one-way spring clutch which transmits the rotation in the direction, which is indicated by the solid line, of the transmission gear 129 to the transmission gear 131, and which, when the transmission gear 129 is rotated in the direction which is indicated by the broken line prevents the rotation from being transmitted to the transmission gear 131. The rotation of the transmission gear 135 in the direction which is indicated by the solid line is transmitted to a torque limiter 133 through a transmission shaft 134. Furthermore, though transmission gears 132 and 130 are rotated in the direction of the arrow indicated by the solid line, they are designed so that the rotation thereof is prevented from being transmitted to the transmission gear 129 by the one-way spring clutch 137. 85 is an ink sheet supply motor which rotatably drives the ink sheet supply roll 17 through transmission gears 186 and 187 and rotates the supply roll 17 in the direction of the arrow C when the ink sheet 14 is conveyed backward (in the direction of the arrow a) during the back feed operation.

By conveying the recording sheet 11 and the ink sheet 14 in reverse directions, the direction in which images are successively recorded in the longitudinal direction of the recording sheet 11 (the direction of the arrow a, that is, the direction reverse of the conveyance direction of the recording sheet 11) and the conveyance direction of the ink sheet 14 correpsond to each other. In this case, it is assumed that the conveyance velocity of the recording sheet 11 $V_P=-n.V_I$ ($V_I$ is the conveyance velocity of the ink sheet 14 and the sign "–" indicates that the conveyance direction of the recording sheet 11 and that of the ink sheet 14 are different).

Then, the relative velocity $V_{PI}$ of the recording sheet 11 and the ink sheet 14 against the thermal head 13 is represented as $V_{PI}=V_P-V_I=(1+1/n)V_P$. It can be found that the relative velocity $V_{PI}$ is higher than $V_P$, that is, higher than the relative velocity $V_{PI}'(=(1-1/n)V_P)$ in the case that the recording sheet 11 and the ink sheet 14 are conventionally conveyed in the same direction.

Besides that, a method in which when "n" number of lines are recorded by the thermal head 13, the ink sheet 14 is conveyed by l/m (l is an integer greater than m) for each n/m line in the direction of the arrow a, or a method in which when the distance corresponding to the length L is recorded, the ink sheet 14 and the recording sheet 11 are conveyed at the same velocity in reverse directions during the recording operation and the ink sheet 14 is rewound by $L\cdot(n-1)/n$ ($n>1$) before the recording operation for the next predetermined amount, may be used. In each case, the relative velocity when the recording operation is performed while the ink sheet 14 is stopped is $V_P$ and the relative velocity when the recording operation is performed while the ink sheet 14 is moving is $2V_P$.

FIG. 13B shows the apparatus in which a manual cutter 15*c* instead of the cutter 15 is mounted downstream of the discharge rollers 16. Even the apparatus having such a composition can obtain the same effect as above by controlling the conveyance without the back feed process, described below. The apparatus shown in FIG. 13A will now be described.

Figure 14:
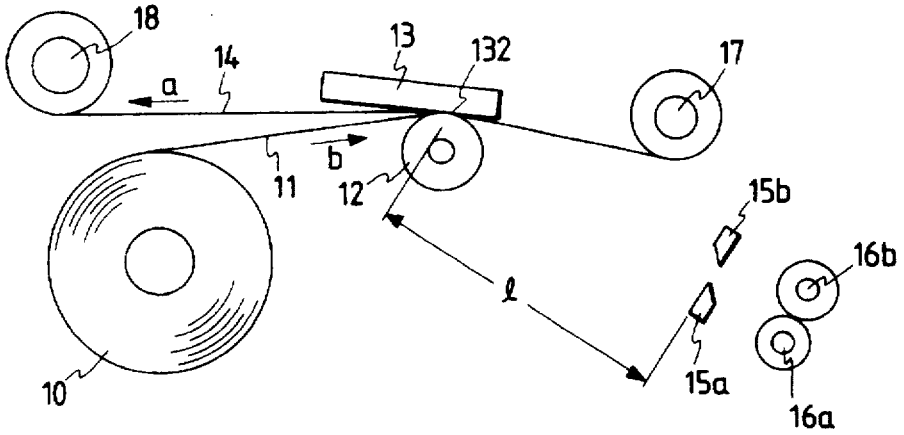
FIGS. 14 to 18 are views showing movement of the recording sheet and the ink sheet in the facsimile apparatus of the embodiment.

FIG. 14 shows the state in which the recording sheet 11 and the ink sheet 14 stand by before the recording operation is started. In this state, the vicinity of the leading end of the recording sheet 11 is positioned at the recording position of the thermal head 13. When the image recording operation is started in this state, the recording sheet 11 is conveyed at the velocity $V_P$ in the direction of the arrow b and the ink sheet 14 is conveyed at the velocity $V_I$ in the direction of the arrow a. The relationship between the conveyance velocities $V_P$ and $V_I$ is set so that $V_P=-nV_I$. The sign "−" indicates that the conveyance direction of the recording sheet 11 and that of the ink sheet 14 are different.

Figure 15:
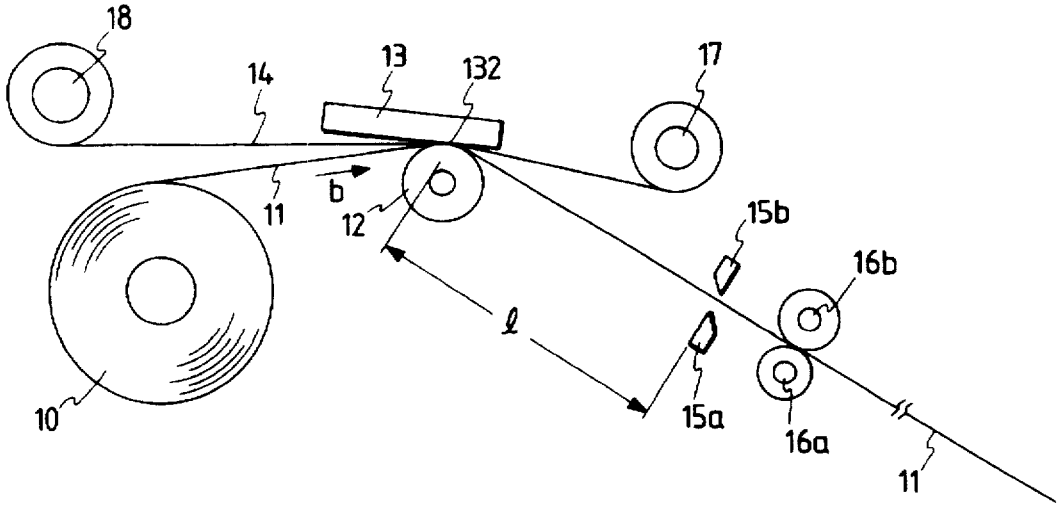

FIG. 15 shows the state in which the image recording operation for one page is completed. In this state, the end portion of the recording sheet 11 by one page which has been recorded abuts against the thermal head 13. Therefore, in order to cut the recording sheet 11 to pages, it is necessary to further convey the recording sheet 11 in the forward direction (the direction of the arrow b) by the distance "l" between the recording position of the thermal head 13 and the cutter 15.

Figure 16A:
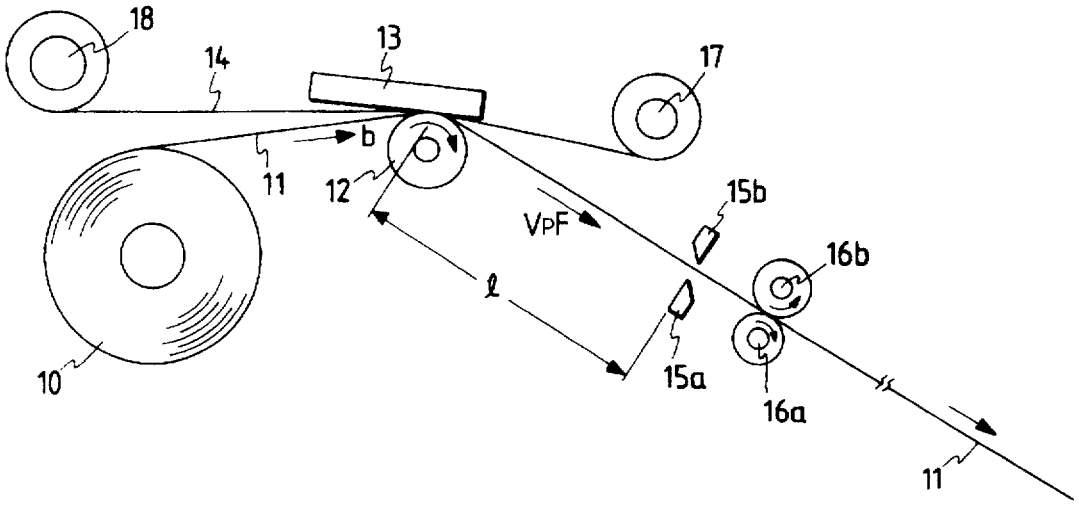

FIG. 16A shows the state in which the recording sheet 11 is being conveyed, and the conveyance velocity of the recording sheet 11 is $V_{PF}$. On the other hand, the ink sheet 14 keeps still while being tensioned between the ink sheet supply roll 17 and the take-up roll 18 due to the holding torque of the ink sheet conveying motor 25.

Figure 17:
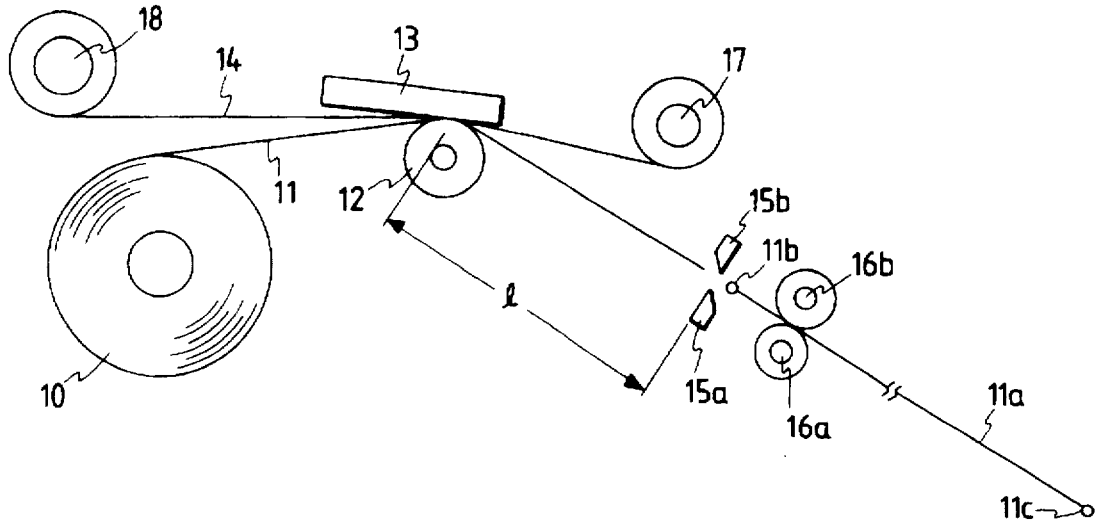

Thus, when the recording sheet 11 is conveyed until the vicinity of the end portion of the recorded recording sheet 11 passes the cutting position of the cutter 15, a motor, not shown, for driving the cutter 115 is driven in response to the direction from the control unit 101, so that the fixed blade 15*a* and the movable blade 15*b* come into engagement and the recording sheet 11 is cut to one page. This operation is shown in FIG. 17. As shown in the figure, 11*a* is a recorded sheet portion of one page, 11*b* is an end portion of the cut page of the recorded sheet 11*a*, and 11*c* is the leading portion of the cut page of the recorded sheet 11*a*.

Figure 18:
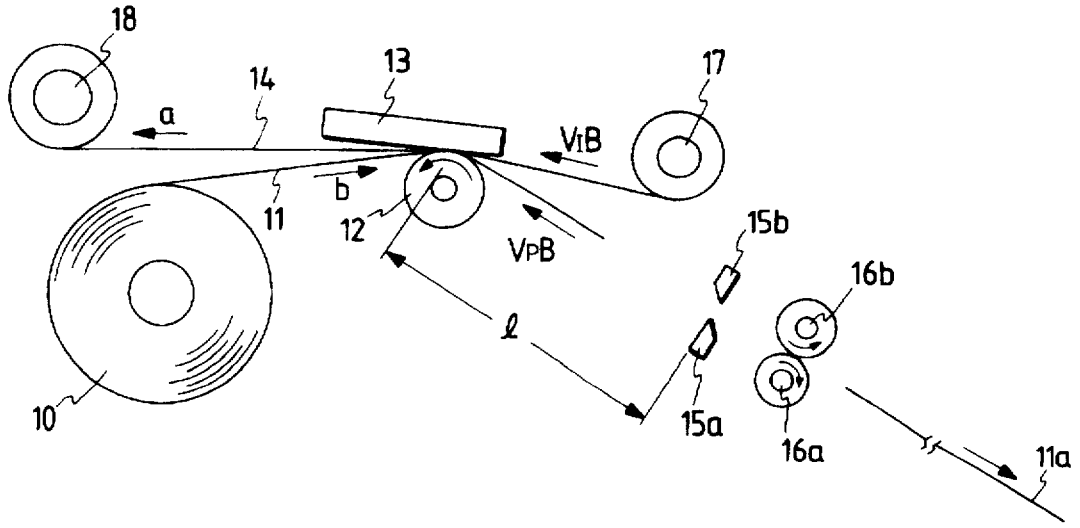

FIG. 18 shows the state in which, after being cut, the recording sheet 11 is rewound in the direction reverse of the direction of the arrow b shown in FIG. 16A and conveyed until the leading portion of the recording sheet 11 comes a little beyond the transfer position of the thermal head 13 toward the side of the discharge roller 16 so that the head portion of the recording sheet 11 for the next recording operation is set ready. At the same time, the cut recorded sheet 11*a* is discharged by the rotation of the eject roller 16 outside of the apparatus.

In this state, the ink sheet 14 is conveyed at the conveyance velocity $V_{IB}=V_{PB}/n_{IB}(n_{IB}>n)$ in the direction of the arrow a. The value $n_{IB}$ is the maximum number of recordings which can be performed without the recording sheet 11 becoming soiled due to the friction between the ink sheet 14 and the recording sheet 11.

In the standby state shown in FIG. 14, after setting the head portion and before performing the next image recording operation, the ink sheet 14 is required to be tensioned without any slack between the ink sheet take-up roll 18 and the thermal head 13. This is because if the ink sheet 14 is slack when the ink sheet take-up roll 18 is rotatably driven so as to start conveying the ink sheet 14, the rotation of the take-up roll 18 only absorbs the slack on the ink sheet 14. As a result, at the time when the image recording operation is started, the ink sheet 14 is not conveyed at the velocity $V_I$. Furthermore, the ink sheet 14 may be sometimes dragged and brought downstream by the conveyance velocity $V_P$ of the recording sheet 11.

In order to prevent the above problems, in the embodiment, an ink sheet tension adjustment mechanism for absorbing the slack of the ink sheet 14 during the back feed operation of the recording sheet 11 is provided. The structure of the mechanism will now be described with reference to FIG. 13.

After the head portion of the recording sheet is set ready, the gear 128 is reversely rotated by the ink sheet conveying motor 25 in the direction of the arrow indicated by the dotted line. The rotation is transmitted to the transmission gear 129 through the transmission gear 128, and the transmission gear 129 is rotated in the direction indicated by the broken line. The transmission gear 130 is rotated by the clutch 137 in the direction indicated by the broken line, while the transmission gear 131 is not rotated. As a result, the reverse rotation of the ink sheet conveying motor 25 is transmitted to the torque limiter 133 through the transmission gears 130 and 132 so as to rotate the torque limiter 133 in the direction indicated by the broken line. The torque limiter 133 is formed to be released from being connected to the transmission shaft 134 and slip if a torque of more than a predetermined amount is applied thereto. Therefore, by adjusting the value of the slip torque so that the ink sheet 14 is not excessively stretched and deformed due to the applied tensile force, the torque limiter 133 is prevented from slipping until the slack is taken in, and rotatably drives the ink sheet take-up roll 18 through the transmission gear 135 and 136. Then, when the ink sheet 14 is tensioned, the torque limiter 133, which is adjusted to receive a force less than the tensile force of the ink sheet 14, begins idling and the rotation of the transmission shaft 134 is stopped. However, when the transmission gear 135 is rotating in the direction indicated by the broken line and the rotation thereof is transmitted to the transmission gear 131, the rotation is prevented from being transmitted to the transmission gear 129 by the one-way clutch 137.

Thus, it is possible to rewind the ink sheet 14 until the ink sheet 14 becomes tense by reversely rotating the ink sheet conveying motor 25 after cutting the recording sheet 11 and conveying the recording sheet 11 backward (in the direction reverse of the direction of the arrow b). As a result, the slack on the ink sheet 14 due to the back feed conveyance of the ink sheet 14 can be prevented from arising, and the ink sheet 14 can be prevented from being excessively conveyed, so that the consumed amount of the ink sheet 14 can be reduced.

[Another Embodiment in the Second Embodiment (FIGS. 16B and 18)]

Figure 16B:
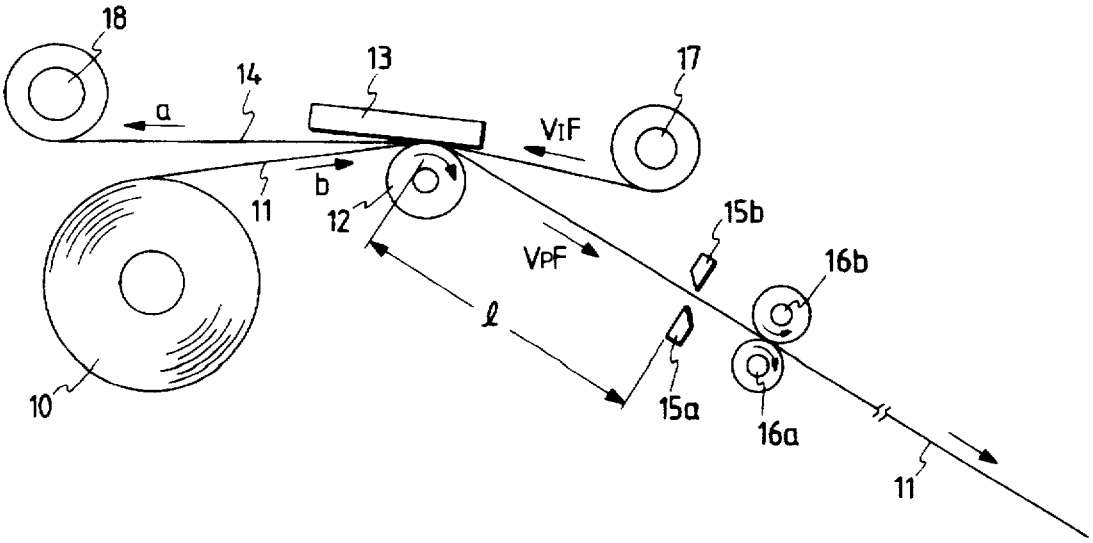

In another embodiment in the second embodiment, only the movement of the recording sheet 11 during the front feed shown in FIG. 16B is different from that in the first embodiment.

In other words, in the present embodiment, when the recording sheet 11 is conveyed toward the discharge roller 16, if the conveyance velocity of the recording sheet 11 is $V_{PF}$, the conveyance velocity of the ink sheet 14 $V_{IF}$ is set so that $V_{IF}=V_{PF}/n_{IF}$. In this case, $n_{IF}>n$ ("n" is equal to the "n" during the recording operation). The $n_{IF}$ is the maximum number of recordings which can be performed without the recording sheet 11 becoming soiled due to the friction between the ink sheet 14 and the recording sheet 11.

Thus, in the front feed of the recording sheet 11, in order to cut the recording sheet 11 to pages, the ink sheet 14 is conveyed at a reduced conveyance velocity. As a result, the recording sheet 11 is prevented from being soiled by the ink sheet 14 and the conveyance thereof can be effectively performed.

[Description of Recording Operation (FIGS. 19 and 20)]

Figure 19:
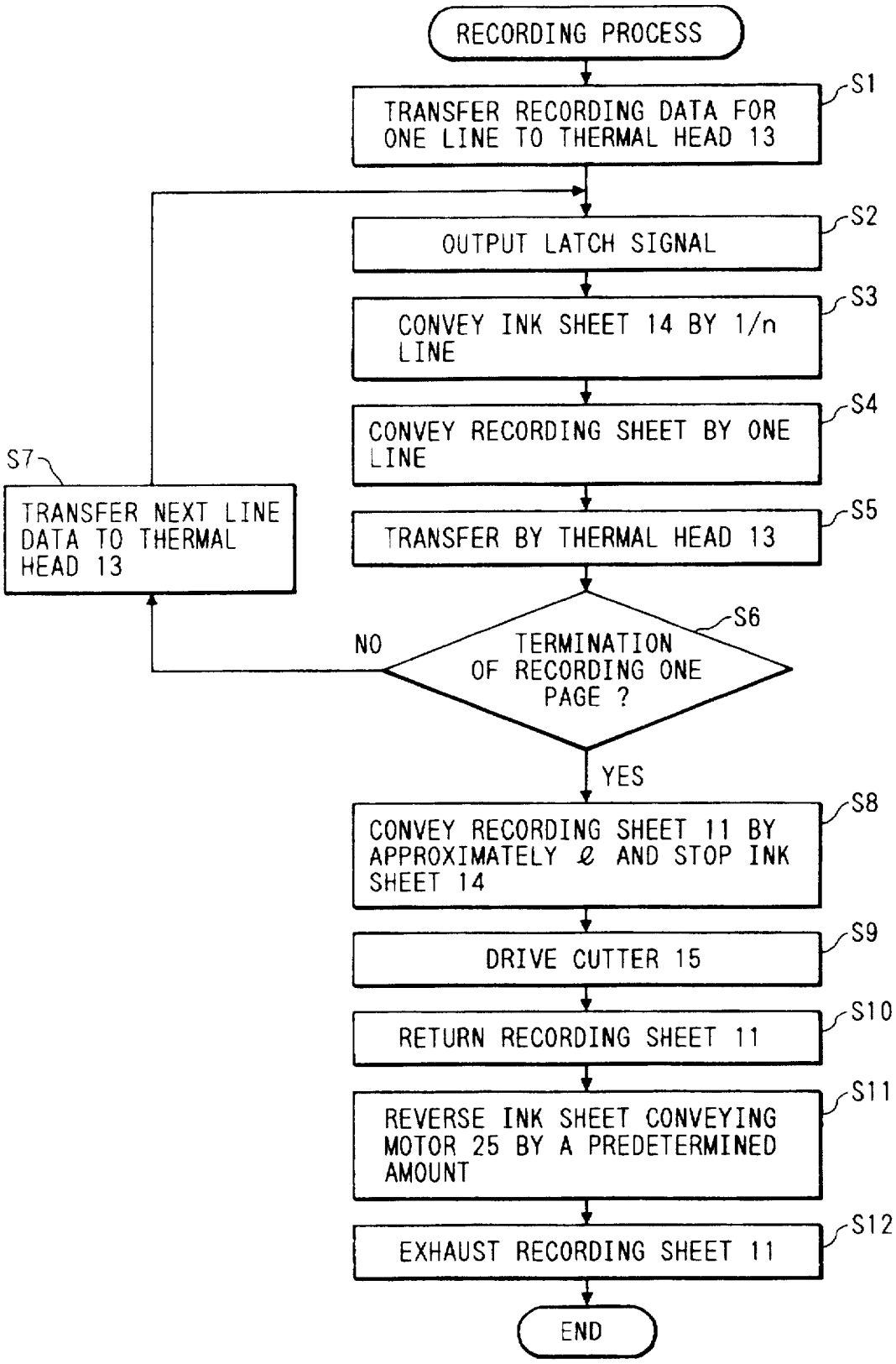
FIG. 19 is a flowchart showing a recording process in the facsimile apparatus of the embodiment.

FIG. 19 is a flowchart showing the recording process in the facsimile apparatus of the second embodiment. The control program for executing this recording process is stored in the ROM 114 in the control unit 101.

The process is started when the image data for one line to be recorded is stored in the line memory 110 and the recording operation is ready. First, the recording data for one line is serially output to the shift register 130 in Step S1. When the transfer of the recording data for one line is completed, the latch signal 44 is output in Step S2 and the recording data for one line is stored in the latch circuit 131. Next, in Step S3, the ink sheet conveying motor 25 and the ink sheet supply motor 85 are driven so that the ink sheet 14 is conveyed by 1/n line in the direction of the arrow a shown in FIG. 12. Then, in Step S4, the recording sheet conveying motor 24 is driven so that the recording sheet 11 is conveyed by one line in the direction of the arrow b. The length of the one line corresponds to the length of one dot to be recorded by the thermal head 13.

In Step S5, the blocks of the heating element 132 of the thermal head 13 are energized one after another. When all of the "m" number of blocks are energized and the recording operation for one line is completed, it is detected in Step S6 whether or not the image recording operation for one page has been completed. If the image recording operation for one page has not been completed, the recording data for the next one line is transferred to the shift register 130 of the thermal head 13 in Step S7. Then, returning to Step S2, the image recording operation is performed as described above.

If the image recording operation for one page has been completed in Step S6, the recording sheet 11 is conveyed toward the discharge rollers **16*a* and 16*b* by a distance corresponding to the length l between the recording position of the thermal head 13 and the cutter 15 in Step S8. At this time, the exciting signal to the ink sheet conveying motor 25 is fixed by the driving circuit 49 and the ink sheet conveying motor 25 is stopped. As a result, the ink sheet 14 is held while being tensioned between the ink sheet supply roll 17 and the ink sheet take-up roll 18**.

Next, the movable blade **15*b* is driven to engage with the fixed blade 15*a* and cuts the recording sheet 11 to pages in Step S9. In Step S10, the back feed of the recording sheet 11 is performed so as to set the head portion of the recording sheet 11 at the recording position. Meanwhile, the ink sheet supply motor 85 is driven, so that the ink sheet 14 is conveyed backward at a lower velocity than the velocity of the recording sheet 11. Then, the ink sheet conveying motor 25 is reversely rotated by a predetermined amount in Step S11. As a result, the ink sheet 14 is tensioned without any slack. Then, the recorded recording sheet 11*a* is discharged from the apparatus by the discharge roller 16 in Step S12**.

Figure 20:
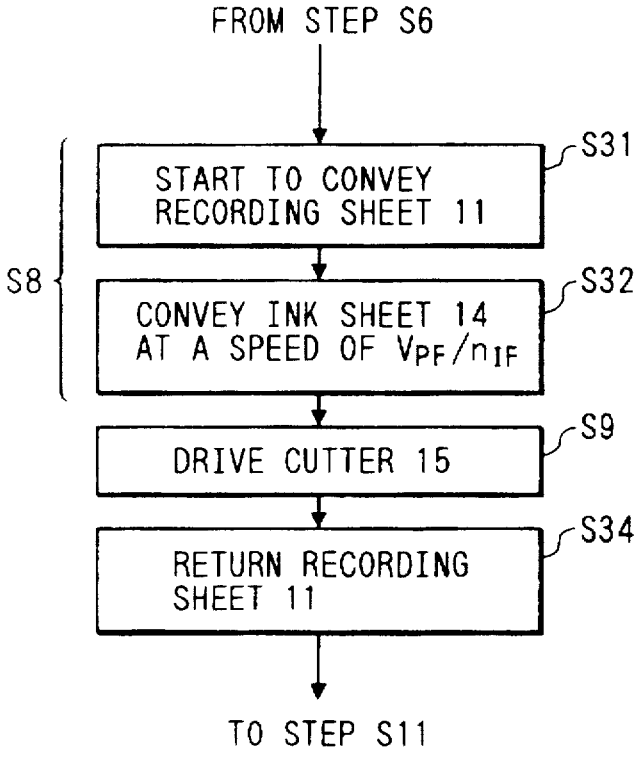
FIG. 20 is a flowchart showing another process in step S10 shown in FIG. 19.

FIG. 20 is a flowchart showing the operation of another embodiment in the second embodiment. The operation can be realized by replacing Steps S8 through S10 shown in FIG. 19 with the flowchart shown in FIG. 20.

The conveyance of the recording sheet 11 is started in Step S31, and the ink sheet supply motor 85 is driven so as to convey the ink sheet 14 at $1/n_{IF}$ of the conveyance velocity $V_{PF}$ of the recording sheet 11 in Step S32. As a result, the recording sheet 11 is conveyed at the velocity $V_{PF}$ by a length almost equal to the distance l between the recording position of the thermal head 13 and the cutting position of the cutter 15. Simultaneously, the ink sheet 14 is conveyed at the conveyance velocity $V_{IF}=V_{PF}/n_{IF}(n_{IF}>n)$. When the recording sheet 11 is cut by the cutter 15 in Step S9, the recording sheet 11 is returned toward the thermal head 13 by a predetermined amount in Step S34, and Step S11 is executed. In this case, "$n_{IF}$" is greater than the above-mentioned "n" and is the number with which the top coating layer of the ink sheet 14 can be conveyed without being worn out due to the friction resulting from contact with the recording sheet 11.

When the ink sheet conveying motor 25 is composed of a stepping motor, the step number of the ink sheet 14 for conveying the recording sheet 11 by one line may be changed, and the value of the above-mentioned "n" can be set by changing the minimum step angle of the motor with the micro step driving.

[Description of Recording Principle (FIG. 21)]

Figure 21:
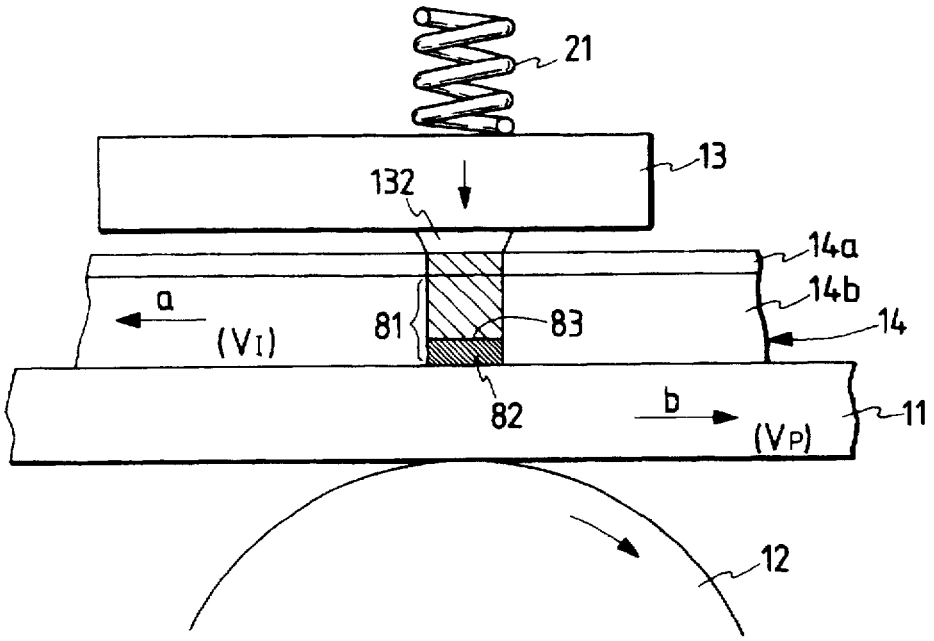
FIG. 21 is a view showing a state of the recording sheet and the ink sheet in a recording operation of the embodiment.

FIG. 21 shows the image recording state in which an image is recorded by conveying the recording sheet 11 and the ink sheet 14 in reverse directions in the present embodiment.

As shown in the figure, the recording sheet 11 and the ink sheet 14 are nipped between the platen roller 12 and the thermal head 13, and the thermal head 13 is pressed against the platen roller 12 by the spring 21 under a predetermined pressure. The recording sheet 11 is conveyed in the direction of the arrow b at the velocity $V_P$ upon the rotation of the platen roller 12. On the other hand, the ink sheet 14 is conveyed in the direction of the arrow a at the velocity $V_I$ upon the rotation of the ink sheet conveying motor 25.

When the heating resistor 132 of the thermal head 13 is supplied with electric power from the power source unit 105 and heated, the shaded portion 81 of the ink sheet 14 is heated. **14*a* is a base film of the ink sheet 14 and 14*b* is an ink layer of the ink sheet 14. By energizing the heating resistor 132, the ink in the heated ink layer 14*b* is melted and the portion 82 is transferred onto the recording sheet 11. The portion 82 of the ink layer 14*b* to be transferred corresponds to almost 1/n of the portion 81 of the ink layer 14*b***.

In transferring, it is necessary to cause the shearing force to be applied against the ink on a border line 83 of the ink layer **14*b* and transfer only the portion 82 of the ink layer 14*b* onto the recording sheet 11. However, the shearing force differs in accordance with the temperature of the ink layer, and it is likely that the higher the temperature of the ink layer, the smaller the shearing force will be. Therefore, since the shearing force in the ink layer 14b is increased when the heating time of the ink sheet 14 is shortened, it is possible to certainly separate the ink layer to be transferred from the ink sheet 14 by increasing the relative velocity of the ink sheet 14 and the recording sheet 11**.

According to the embodiment, since the heating time of the thermal head 13 in the facsimile apparatus is short, approximately 0.6 ms, the relative velocity of the ink sheet 14 and the recording sheet 11 is increased by conveying the ink sheet 14 and the recording sheet 11 in opposite directions.

[Description of Ink Sheet (FIG. 22)]

Figure 22:
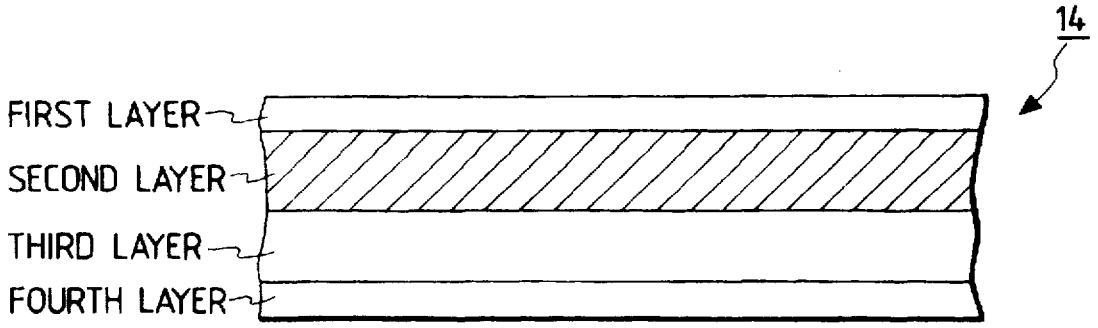
FIG. 22 is a sectional view of the ink sheet used in the embodiment.

FIG. 22 is a sectional view of the ink sheet 14 used for multi-printing. The case of the ink sheet composed of four layers will now be described.

A second layer is a base film which is a supporting member of the ink sheet 14. In the case of multi-printing, since heat energy is applied to the same portion many times, an aromatic polyamide film and a condenser paper, which have high heat resistance, are advantageous as a base film. However, even a conventional polyester film can be used. Though it is advantageous for printing quality that the base film be made as thin as possible in consideration of the function as a medium, but the base film will preferably be between 3 and 8 μm from the point of view of the strength.

A third layer is an ink layer in which the ink of an amount is capable of being transferred onto the recording paper (recording sheet) "n" number of times. The main components of the ink layer are resin, such as EVA as an adhesive agent, carbon black or nigrosine dye for coloring, carnauba wax or paraffin wax as a binding agent, and are compounded so that the same portion of the ink layer can be used "n" number of times. Though the amount applied will preferably be between 4 and 8 g/m$^2$, since the sensitivity and the density vary in accordance with the amount, the amount can be optionally selected.

A fourth layer is a top coating layer mounted so that the ink in the third layer is not transferred onto the recording sheet by pressure in the portion not to be printed, and is composed of transparent wax or the like. Therefore, only the transparent fourth layer is transferred by pressure and it is possible to prevent the recording sheet from being soiled. A first layer is a heat-resistant coating layer for protecting the base film of the second layer from the heat of the thermal head 13. The heat-resistant layer is suitable for multi-printing in which the heat energy for "n" number of lines may be applied to the same portion (in the case in which the successive information for black is given). However, the use of the layer may be appropriately selected. In the case that a base film, such as a polyester film, whose heat resistance in comparatively low, is used, the use of the layer is advantageous.

The composition of the ink sheet is not limited to the above composition. For example, the ink sheet may be composed of a base layer and a porous ink holding layer which is disposed on one side of the base layer and contains ink, or may be provided with a heat-resistant ink layer, which has a minute porous meshed structure and contains ink therein, disposed on a base film.

As a base film, for example, a film or paper composed of polyamide, triacetyl cellulose, nylon, polyvinyl chloride, polypropylene and so on may be used. Furthermore, though a heat-resistant coating layer is not always necessary, the material of the layer may be, for example, silicon resin, epoxy resin, melamine resin and so on.

The ink to be applied onto the ink sheet 14 is not limited to heat melting ink, and may be heat sublimating ink. In heat sublimating ink sheet, a coloring material layer which contains spacer particles composed of guanamine resin and fluorocarbon resin is mounted on a base member composed of, for example, polyethylene terephthalate, aromatic polyamide or the like.

Furthermore, the heating method is not limited to the above-mentioned thermal head method using a thermal head and, for example, an electric transfer method, a laser transfer method or the like can be used.

Though the case in which the recording sheet 11 and the ink sheet 14 are conveyed in reverse directions during the recording operation is described in this embodiment, the present invention is not limited to this embodiment and can be also applied to the case in which the recording sheet 11 and the ink sheet 14 are conveyed in the same direction.

Still furthermore, the recording medium is not limited to recording paper and may be a material onto which the ink can be transferred, for example, cloth, a plastic sheet or the like. As for the loading of the ink sheet, a supply roll and a take-up roll may be separately loaded in the main body of the recording apparatus as shown in the second embodiment, or, for example, what is called an ink sheet cassette, in which the ink sheet is contained in a housing detachable from the main body of the recording apparatus and the housing is loaded and detached into and from the main body of the recording apparatus, may be used.

Though, a full-line type thermal transfer recording apparatus is described in the above embodiments, the present invention is not limited to this type, and may be what is called a serial type thermal transfer recording apparatus.

Though an image recording operation with a multi-printing ink sheet is described in the above embodiments, the present invention is not limited to this, and the recording operation can be similarly performed in the case in which a normal one-time ink sheet is used.

Furthermore, though the present invention is applied to the facsimile apparatus as a thermal transfer recording apparatus in the above embodiments, the present invention is not limited to the apparatus and the thermal transfer recording apparatus of the present invention may be employed as, for example, a word processor, a typewriter, a copying machine or the like.

Though the mechanism for opening and closing the cover each time the ink sheet is loaded and detached is used in the above first embodiment, the present invention is not limited to this structure. Needless to say, the structure in which the ink sheet can be loaded into the main body without opening the cover, for example, the structure in which the ink sheet can be loaded by being inserted may be used.

As described above, according to the above first embodiment, since when the ink cartridge is exchanged, the slack can be automatically taken up, a take-up knob of the cartridge is unnecessary, and wrinkling and folding of the ink sheet, which are caused by failure to take up the slack on the ink sheet, can be prevented. The take-up knob of the cartridge may be provided in consideration of the case in which, after the cartridge is loaded and the slack on the ink sheet is taken up by using the present invention, the ink sheet again slackens for another cause.

According to the above first embodiment, since the slack is taken up by conveying the ink sheet by the minimum amount, the waste of the ink sheet can be reduced in taking up the slack.

As described above, according to the above first embodiment, when the ink sheet is loaded, the slack on the ink sheet can be taken up by automatically taking up the ink sheet by a predetermined amount. Besides that, for example, a member for preventing the slack on the ink sheet is not necessary on the ink sheet cartridge and so on, and the operation or the mechanism in the main body for opening the above slack preventing member when the ink sheet is loaded is not necessary.

Furthermore, according to the above first embodiment, by detecting whether or not the cover of the recording apparatus in which, for example, the ink sheet roll, the ink sheet cartridge or the like is loaded, is open and taking up the ink sheet by a predetermined amount in accordance with the detection result, it is possible to take up the slack on the ink sheet.

The ink sheet is prevented from being excessively taken up by providing a control means for controlling the conveyance of the ink sheet so that the ink sheet is conveyed until the supply roll starts to rotate. Then, noise and vibration can be restricted when the slack on the ink sheet is taken up, by conveying the ink sheet while reducing the driving current for the ink sheet conveying means when the cover is open.

By mounting a control means for controlling the conveyance of the ink sheet so that the ink sheet driving means automatically conveys the ink sheet by a predetermined amount or until the supply roll starts to rotate when it is detected that the cover is closed, the necessary tension is applied to the ink sheet and the ink sheet and the recording medium are prevented from sticking to each other in the multi-printing recording operation. As a result, the quality of the recorded image in the multi-printing can be enhanced.

Though the back feed of the recording sheet 11 accompanies the cutting operation of the recording sheet 11 by the cutter 15 in the above second embodiment, the present invention is not limited to this. For example, the back feed may be applied to the case in which the leading portion of the recording sheet 11 is conveyed to the cutting position in exchanging the recording sheet 11 or the case in which the leading portion of the recording sheet 11 is conveyed backward to the image recording position of the thermal head 13.

Furthermore, though the slack is taken up after the recording sheet 11 returns to a standby state in the back feed in the above second embodiment, the present invention is not limited to this, and the slack may be taken up at the same time as the back feed.

As described above, according to the above second embodiment, by tensioning and stopping the ink sheet during the front feed of the recording sheet and tensioning the ink sheet by the reverse rotation of the ink sheet conveying motor during the back feed of the recording sheet, soil on the surface of the recording sheet, wrinkles and slack on the ink sheet, and furthermore, the waste of the ink sheet during the conveyance operation can be prevented.

As described above, according to the above second embodiment, the ink sheet is stopped when the recording medium is conveyed forward in cutting or exchanging the recording medium, or the ink sheet is conveyed at a predetermined velocity in the same direction as that of the recording medium when the recording medium is conveyed forward and the ink sheet is conveyed in the same direction as the recording medium and is tensioned by the reverse rotation of the ink sheet conveying motor when the recording medium is conveyed backward. As a result, the slack and wrinkles on the ink sheet and the waste of the ink sheet to be conveyed can be prevented, and the surface of the recording medium can be prevented from being soiled.

As described above, according to the present invention, it is possible to provide a thermal transfer apparatus and a thermal transfer method which can obtain a clear image by taking up the wrinkle and slack on the ink sheet.

We claim:

1. A thermal transfer recording apparatus for recording an image on a recording medium by transferring an ink from an ink sheet onto said recording medium, the apparatus being located in an apparatus body having a cover openable and closable with respect to the apparatus body, the apparatus comprising:

a loading portion for detachably loading said ink sheet therein;

an ink sheet driving portion for conveying said ink sheet from an ink sheet supply reel to an ink sheet winding reel;

a recording medium conveying portion for conveying said recording medium;

a thermal recording portion for transferring said ink from said ink sheet loaded in said loading portion to record said image on said recording medium;

a first detecting portion for detecting that said ink sheet is loaded on said loading portion;

a second detecting portion for detecting a rotation of said ink sheet supply reel;

a cover opening detecting portion for detecting an opening of the cover; and a control portion for controlling said ink sheet driving portion after said cover opening detecting portion detects the opening of the cover until said second detecting portion detects the rotation of said ink sheet supply reel in accordance with a loading detection of said ink sheet by said first detecting portion.

2. A thermal transfer recording apparatus according to claim 1, wherein said ink sheet is contained in an ink sheet cartridge comprising said supply reel around which said ink sheet is wound and said ink sheet winding reel for taking up said ink sheet fed out from said supply reel.

3. A thermal transfer recording apparatus according to claim 1, wherein the cover is swingably mounted on the main body of said apparatus, and said first detecting portion detects that said ink sheet is loaded into said loading portion by detecting that the cover has swung from said main body of said apparatus to an open state, indicating that said ink sheet is loaded.

4. A thermal transfer recording apparatus as in claim 3, wherein said ink sheet is conveyed while reducing a driving current for said ink sheet driving portion while said recording apparatus is in the open state in which said cover is swung outward from said main body of said apparatus.

5. A recording apparatus according to claim 1, wherein said ink sheet is conveyed at a first conveyance speed and said recording medium is conveyed at a second conveyance speed, said first conveyance speed being lower than said second conveyance speed.

6. A recording apparatus according to claim 1, wherein said ink sheet is conveyed in a first conveyance direction and said recording medium is conveyed in a second conveyance direction, said first direction being opposite to said second direction.

7. A thermal transfer recording apparatus according to claim 1 wherein said recording apparatus is a facsimile apparatus for recording the image in response to a signal received through a communication line.

8. A thermal transfer recording method for recording an image on a recording medium using a thermal transfer recording apparatus located in an apparatus body having a cover openable and closable with respect to the apparatus body, the method comprising the steps of:

transferring an ink from an ink sheet onto said recording medium;

conveying said ink sheet from an ink sheet supply reel to an ink sheet winding reel;

detecting that said ink sheet is loaded on a loading portion of said apparatus;

detecting rotation of said ink sheet supply reel;

detecting an opening of the cover; and controlling the conveyance of said ink sheet after detection of the opening of the cover until rotation of said ink sheet supply reel is detected in accordance with detection of loading said ink sheet on said loading portion.

9. A thermal transfer recording method as in claim 8, further comprising the step of:

containing said ink sheet in a cartridge comprising said supply reel around which said ink sheet is wound and said winding reel for taking up said ink sheet taken out from said supply reel.

10. A thermal transfer recording method as in claim 8, further comprising the step of providing said ink sheet wound around said supply reel, wherein said supply reel is independently loadable into and detachable from a main body of said apparatus.

11. A thermal transfer recording method according to claim 8 wherein said method is employed in a facsimile apparatus for recording the image in response to a signal received through a communication line.

12. A thermal transfer recording method for recording an image on a recording medium by transferring an ink from an ink sheet onto said recording medium, comprising the steps of:

transferring said ink from said ink sheet, thereby recording said image on said recording medium;

conveying said ink sheet with a first conveyance speed and in a first conveyance direction;

conveying said recording medium with a second conveyance speed and in a forward conveyance direction and a backward conveyance direction opposite to said forward conveyance direction:

cutting said recording medium: and controlling conveyance of said ink sheet so that said ink sheet is conveyed in said first conveyance direction, said first conveyance direction being opposite to said forward conveyance direction and said first conveyance speed being lower than said second conveyance speed when, after said transferring step, said recording medium is conveyed in said forward conveyance direction so as to be cut in said cutting step, and so that said ink sheet is conveyed in said first conveyance direction and said first conveyance speed is lower than said second conveyance speed when said recording medium is conveyed in said backward conveyance direction after being cut in said cutting step;

said method further comprising the step of applying tension to said ink sheet after conveying said recording medium and said ink sheet and prior to the transferring step of a next recording operation.

13. A thermal transfer recording method for recording an image on a recording medium by transferring an ink from an ink sheet onto said recording medium, comprising the steps of:

transferring said ink from said ink sheet, thereby recording said image on said recording medium;

conveying said ink sheet with a first conveyance speed and in a first conveyance direction;

conveying said recording medium with a second conveyance speed and in a forward conveyance direction and a backward conveyance direction opposite to said forward conveyance direction;

cutting said recording medium; and controlling conveyance of said ink sheet so that said ink sheet is conveyed in said first conveyance direction, said first conveyance direction being opposite to said forward conveyance direction and said first conveyance speed being lower than said second conveyance speed when, after said transferring step, said recording medium is conveyed in said forward conveyance direction so as to be cut in said cutting step, and so that said ink sheet is conveyed in said first conveyance direction and said first conveyance speed is lower than said second conveyance speed when said recording medium is conveyed in said backward conveyance direction after being cut in said cutting step;

said method further comprising the step of providing ink sheet take-up means for taking up said ink sheet and for controlling conveyance of said ink sheet, a torque limiter being mounted to said ink sheet take-up means.

14. A thermal transfer recording apparatus for recording an image on a recording medium by transferring an ink from an ink sheet onto said recording medium, the apparatus being located in an apparatus body having a cover openable and closable with respect to the apparatus body, the apparatus comprising:

a loading portion for detachably loading said ink sheet therein;

an ink sheet driving portion for conveying said ink sheet from an ink sheet supply reel to an ink sheet winding reel;

a recording medium conveying portion for conveying said recording medium;

a thermal recording portion for transferring said ink from said ink sheet loaded in said loading portion to record said image on said recording medium;

a first detecting portion for detecting that said ink sheet is loaded on said loading portion;

a second detecting portion for detecting a rotation of said ink sheet supply reel;

a cover opening detecting portion for detecting an opening of the cover; and a control portion for starting a conveyance of said ink sheet by said ink sheet driving portion, after said cover opening detecting portion detects the opening of the cover, in response to detection of said ink sheet by said first detecting portion and continuing the conveyance of said ink sheet by said ink sheet driving portion until said second detecting portion detects the rotation of said ink sheet supply reel.

15. A thermal transfer recording apparatus according to claim 14, wherein the cover is swingably mounted on said apparatus body, and said first detecting portion detects that said ink sheet is loaded into said loading portion by detecting that the cover has swung from said main body of said apparatus to an open state, indicating that said ink sheet is loaded.

16. A thermal transfer recording method for recording an image on a recording medium using a thermal transfer recording apparatus located in an apparatus body having a cover openable and closable with respect to the apparatus body, the method comprising the steps of:

transferring an ink from an ink sheet onto said recording medium;

conveying said ink sheet from an ink sheet supply reel to an ink sheet winding reel;

detecting that said ink sheet is loaded on a loading portion of said apparatus;

detecting rotation of said ink sheet supply reel;

detecting an opening of the cover; and starting the conveyance of said ink sheet after detection of the opening of the cover in response to the detection that said ink sheet is loaded and continuing the conveyance of said ink sheet until the rotation of said ink sheet supply reel is detected.

17. A thermal transfer recording apparatus for recording an image on a recording medium by transferring ink from an ink sheet onto said recording medium, the apparatus comprising:

a housing;

a cover attached to said housing, said cover being openable and closeable with respect to said housing;

a loading portion located in said cover for detachably loading said ink sheet therein;

an ink sheet driving portion for conveying an ink sheet from an ink sheet supply reel to an ink sheet winding reel;

a recording medium conveying portion for conveying a recording medium;

a thermal recording portion for transferring ink from an ink sheet loaded in said loading portion to record said image on said recording medium;

a first detecting portion for detecting that said ink sheet is loaded in said loading portion;

a second detecting portion for detecting a rotation of said ink sheet supply reel;

a third detecting portion for detecting that said cover is in a predetermined separated state with respect to said housing; and a control portion for starting a conveyance of said ink sheet by said ink sheet driving portion, after said third detection portion has detected the opening of the cover, in response to a detection of said ink sheet by said first detecting portion and continuing the conveyance of said ink sheet by said ink sheet driving portion until said second detecting portion detects the rotation of said ink sheet supply reel.

18. An apparatus according to claim 17, wherein said ink sheet is capable of being mounted on said first housing when said first housing is in said predetermined separated state.

19. A thermal transfer recording apparatus according to claim 17, wherein said ink sheet is contained in an ink sheet cartridge comprising said supply reel around which said ink sheet is wound and said ink sheet winding reel for taking up said ink sheet fed out from said supply reel.

20. A thermal transfer recording apparatus as in claim 17, wherein said ink sheet is conveyed while reducing a driving current for said ink sheet driving portion while said recording apparatus is in an open state in which said cover is swung outward from a main body of said apparatus.

21. A recording apparatus according to claim 17, wherein said ink sheet is conveyed at a first conveyance speed and said recording medium is conveyed at a second conveyance speed, said first conveyance speed being lower than said second conveyance speed.

22. A recording apparatus according to claim 17, wherein said ink sheet is conveyed in a first conveyance direction and said recording medium is conveyed in a second conveyance direction, said first direction being opposite to said second direction.

23. A thermal transfer recording apparatus according to claim 17 wherein said recording apparatus is a facsimile apparatus for recording the image in response to a signal received through a communication line.

24. A thermal transfer recording method for recording an image on a recording medium by transferring an ink from an ink sheet onto said recording medium, comprising the steps of;

providing a housing;

providing a cover attached to said housing, said cover being openable and closeable with respect to said housing;

providing a loading portion in said cover for detachably loading said ink sheet therein;

conveying said ink sheet from an ink sheet supply reel to an ink sheet winding reel;

conveying said recording medium;

transferring ink from said ink sheet loaded in said loading portion to record said image on said recording medium;

a first detecting step of detecting that said ink sheet is loaded in said loading portion;

a second detecting step of detecting a rotation of said ink sheet supply reel;

a third detecting step of detecting that said cover is in a predetermined separated state with respect to said housing;

starting a conveyance of said ink sheet, after detection of the opening of said cover, in response to a detection of said ink sheet in said first detecting step; and continuing the conveyance of said ink sheet until detection of the rotation of the ink sheet supply reel in said second detecting step after a detection in said third detecting step that said second housing is in the predetermined separated state with respect to said first housing.

25. A thermal transfer recording method as in claim 16, further comprising the step of:

containing said ink sheet in a cartridge comprising said supply reel around which said ink sheet is wound and said winding reel for taking up said ink sheet taken out from said supply reel.

26. A thermal transfer recording method as in claim 16, further comprising the step of providing said ink sheet wound around said supply reel, wherein said supply reel is independently loadable into and detachable from a main body of said apparatus.

27. A thermal transfer recording apparatus for recording an image on a recording medium by transferring ink from an ink sheet onto said recording medium, the apparatus comprising:

a first housing;

a second housing attached to said housing, said second housing being openable and closeable with respect to said first housing;

a loading portion located in said second housing for detachably loading said ink sheet therein;

an ink sheet driving portion for conveying said ink sheet from an ink sheet supply reel to an ink sheet winding reel;

a recording medium conveying portion for conveying a recording medium;

a thermal recording portion for transferring ink from said ink sheet loaded in said loading portion to record said image on said recording medium;

a first detecting portion for detecting that an ink sheet is loaded in said loading portion;

a second detecting portion for detecting a rotation of said ink sheet supply reel;

a third detecting portion for detecting that said second housing is in a predetermined separated state with respect to said first housing; and a control portion for starting a conveyance of said ink sheet by said ink sheet driving portion, after said third detection portion has detected the opening of the second housing, in response to a detection of said ink sheet by said first detecting portion and continuing the conveyance of said ink sheet by said ink sheet driving portion until said second detecting portion detects the rotation of said ink sheet supply reel.

28. A thermal transfer recording method for recording an image on a recording medium by transferring an ink from an ink sheet onto said recording medium, comprising the steps of;

providing a first housing;

providing a second housing attached to said first housing, said second housing being openable and closeable with respect to said first housing;

providing a loading portion in said second housing for detachably loading an ink sheet therein;

conveying said ink sheet from an ink sheet supply reel to an ink sheet winding reel;

conveying said recording medium;

transferring ink from said ink sheet loaded in said loading portion to record said image on said recording medium;

a first detecting step of detecting that said ink sheet is loaded in said loading portion;

a second detecting step of detecting a rotation of said ink sheet supply reel;

a third detecting step of detecting that said second housing is in a predetermined separated state with respect to said first housing;

starting a conveyance of said ink sheet, after detection of the opening of said second housing, in response to a detection of said ink sheet in said first detecting step; and continuing the conveyance of said ink sheet until detection of the rotation of the ink sheet supply reel in said second detecting step.

29. A thermal transfer recording method according to claim 16 wherein said method is employed in a facsimile apparatus for recording the image in response to a signal received through a communication line.

* * * * *

UNITED STATES PATENT AND TRADEMARK OFFICE

CERTIFICATE OF CORRECTION

PATENT NO. : 5,786,842

DATED : July 28, 1998

INVENTOR(S) : TAKASHI AWAI ET AL.

It is certified that error appears in the above-identified patent and that said Letters Patent is hereby corrected as shown below:

On the title page,

AT [56], FOREIGN PATENT DOCUMENTS

"01554483" should read --0155483--.

COLUMN 1

Line 29, "package" should read --packaged--;
Line 42, "rewind" should read --wind--.

COLUMN 2

Line 13, "pages" should read --page lengths--;
Line 41, "ink" should read --an ink--;
Line 51, "a" should read --an--.

COLUMN 3

Line 4, "of" should read --from--; and "from" should read --of--;
Line 37, "cause" should read --causes--;
Line 39, "record" should read --records--.

COLUMN 5

Line 36, "discharge" should read --discharged--.

COLUMN 6

Line 3, "different" should be deleted;
Line 54, "the" should read --be--;
Line 65, "circuit 25" should read --circuit 49--.

UNITED STATES PATENT AND TRADEMARK OFFICE

CERTIFICATE OF CORRECTION

PATENT NO. : 5,786,842

DATED : July 28, 1998

INVENTOR(S) : TAKASHI AWAI ET AL.

It is certified that error appears in the above-identified patent and that said Letters Patent is hereby corrected as shown below:

COLUMN 8

Line 43, "are" should read --is--.

COLUMN 9

Line 52, "eject" should read --discharge--.

COLUMN 11

Line 58, "cutter 115" should read --cutter 15--.

COLUMN 12

Line 7, "eject" should read --discharge--;
Line 54, "gear 135" should read --gears 135--.

COLUMN 15

Line 39, "mounted" should read --provided--.

UNITED STATES PATENT AND TRADEMARK OFFICE

CERTIFICATE OF CORRECTION

PATENT NO. : 5,786,842

DATED : July 28, 1998

INVENTOR(S) : TAKASHI AWAI ET AL.

It is certified that error appears in the above-identified patent and that said Letters Patent is hereby corrected as shown below:

COLUMN 16

Line 29, "Though," should read --Though--.

COLUMN 17

Line 21, "mounting" should read --providing--.

COLUMN 22

Line 54, "said housing," should read --said first housing--;
Line 8, "of;" should read --of:--.
Line 38, "claim 16," should read --claim 24,--;
Line 44, "claim 16," should read --claim 24,--.

UNITED STATES PATENT AND TRADEMARK OFFICE

CERTIFICATE OF CORRECTION

PATENT NO. : 5,786,842

DATED : July 28, 1998

INVENTOR(S) : TAKASHI AWAI ET AL.

It is certified that error appears in the above-identified patent and that said Letters Patent is hereby corrected as shown below:

COLUMN 23

Line 10, "detection" should read --detecting--;
Line 19, "of" should read --of;--.

Signed and Sealed this

Eleventh Day of May, 1999

*Attest:*

*Attesting Officer*

Q. TODD DICKINSON

*Acting Commissioner of Patents and Trademarks*